US007605334B2

(12) United States Patent
Naganuma et al.

(10) Patent No.: US 7,605,334 B2
(45) Date of Patent: Oct. 20, 2009

(54) ROTARY SWITCH DEVICE

(75) Inventors: Yasunori Naganuma, Miyazaki (JP); Masahiko Harada, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 157 days.

(21) Appl. No.: 11/792,075

(22) PCT Filed: Dec. 9, 2005

(86) PCT No.: PCT/JP2005/022626

§ 371 (c)(1),
(2), (4) Date: Jun. 1, 2007

(87) PCT Pub. No.: WO2006/080147

PCT Pub. Date: Aug. 3, 2006

(65) Prior Publication Data

US 2008/0121502 A1 May 29, 2008

(30) Foreign Application Priority Data

| | | |
|---|---|---|
| Jan. 31, 2005 | (JP) | 2005-024236 |
| Jan. 31, 2005 | (JP) | 2005-024237 |
| Jan. 31, 2005 | (JP) | 2005-024238 |
| Jan. 31, 2005 | (JP) | 2005-024239 |
| Jan. 31, 2005 | (JP) | 2005-024240 |

(51) Int. Cl.
*H01H 19/58* (2006.01)

(52) U.S. Cl. ..... 200/11 A; 200/336

(58) Field of Classification Search ..... 200/13, 200/43.01, 43.03, 43.04, 43.08, 6 R, 336, 200/564, 11 A See application file for complete search history.

(56) References Cited

U.S. PATENT DOCUMENTS 3,632,913 A * 1/1972 Hukuta ..... 200/43.08

(Continued)

FOREIGN PATENT DOCUMENTS

JP 58-71917 U 5/1983

(Continued)

*Primary Examiner*—Michael A Friedhofer
*Assistant Examiner*—Lisa N Klaus
(74) *Attorney, Agent, or Firm*—Arent Fox LLP

(57) ABSTRACT

A rotary switch device is provided that includes first and second switch mechanisms each formed from a movable contact point that pivots in response to pivoting of a pivoting shaft and a fixed contact point that comes into contact with the movable contact point at a set pivot position of the pivoting shaft, the first switch mechanism being formed from the movable contact point (65 to 68) disposed on one face of a single rotor (28) coaxially connected to the pivoting shaft (25) so that the rotor (28) cannot rotate relative to the pivoting shaft (25), and the fixed contact point (69 to 72) provided on an inner face, corresponding to one face of the rotor (28), of one (30) of a pair of case halves (30, 31) joined to each other while sandwiching the rotor (28) from opposite sides so as to form a switch case housing the rotor (28), and the second switch mechanism being formed from the movable contact point (85 to 88) disposed on the other face of the rotor (28) and the fixed contact point (89 to 92) provided on an inner face of the other case half (31) facing the other face of the rotor (28). This enables the dimensions to be reduced while decreasing the number of components.

29 Claims, 23 Drawing Sheets

U.S. PATENT DOCUMENTS

| | | | | | |
|---|---|---|---|---|---|
| 5,563,387 | A | * | 10/1996 | Myers et al. | 200/43.03 |
| 5,756,947 | A | * | 5/1998 | Trimble et al. | 200/11 C |
| 5,833,049 | A | * | 11/1998 | Yamashita et al. | 200/284 |
| 6,114,638 | A | | 9/2000 | Naganuma et al. | |
| 6,723,934 | B2 | * | 4/2004 | Enright | 200/61.54 |
| 7,290,416 | B2 | * | 11/2007 | Ohtaki et al. | 70/252 |
| 7,435,919 | B2 | * | 10/2008 | Hidaka | 200/43.08 |

FOREIGN PATENT DOCUMENTS

| | | | |
|---|---|---|---|
| JP | 58-104532 | U | 7/1983 |
| JP | 59-55840 | U | 4/1984 |
| JP | 61-49931 | U | 4/1986 |
| JP | 4-98724 | A | 3/1992 |
| JP | 04-262328 | A | 9/1992 |
| JP | 5-65025 | U | 8/1993 |
| JP | 11-238432 | A | 8/1999 |
| JP | 11-238438 | A | 8/1999 |
| JP | 2000-133086 | A | 5/2000 |
| JP | 2001-093750 | A | 4/2001 |
| JP | 2002-025395 | A | 1/2002 |
| JP | 2002-124156 | A | 4/2002 |
| JP | 2004-006069 | A | 1/2004 |

* cited by examiner

ROTARY SWITCH DEVICE

CROSS-REFERENCE TO RELATED APPLICATION

This application is a National Stage entry of International Application No. PCT/JP2005/011626, filed Dec. 9, 2005, the entire specification claims and drawings of which are incorporated herewith by reference.

TECHNICAL FIELD

The present invention relates to a rotary switch device that includes first and second switch mechanisms each formed from a movable contact point that pivots in response to pivoting of a pivoting shaft and a fixed contact point that comes into contact with the movable contact point at a set pivot position of the pivoting shaft and, in particular, to a rotary switch device that is suitably used for a vehicular ignition switch.

BACKGROUND ART

A vehicular ignition switch is disposed in a confined space and is therefore required to have small dimensions, but since a general ignition switch has an arrangement as disclosed in Patent Publication 1 in which movable contact points are disposed along two, that is, large and small, imaginary circles having different diameters on one face of a rotor that pivots together with a pivoting shaft, and these movable contact points are in sliding contact with a fixed contact point, the dimensions tend to increase in the radial direction. On the other hand, an ignition switch having an arrangement in which two movable contact points having identical diameters are disposed at positions spaced in the axial direction of a pivoting shaft is disclosed in Patent Publication 2, and in accordance with this ignition switch, it is possible to reduce the radial dimensions.

[Patent Publication 1]

Japanese Patent Application Laid-open No. 11-238438

[Patent Publication 2]

Japanese Patent Application Laid-open No. 2002-124156

DISCLOSURE OF THE INVENTION

Problems to be Solved by the Invention

However, in the arrangement disclosed in Patent Publication 2, the axial length of the ignition switch increases in the axial direction and, moreover, the number of components is large.

The present invention has been accomplished under such circumstances, and it is an object thereof to provide a rotary switch device that enables the dimensions to be reduced while decreasing the number of components.

Means for Solving the Problems

In order to accomplish the above object, according to a first aspect of the present invention, there is proposed a rotary switch device comprising first and second switch mechanisms each formed from a movable contact point that pivots in response to pivoting of a pivoting shaft and a fixed contact point that comes into contact with the movable contact point at a set pivot position of the pivoting shaft, characterized in that the first switch mechanism is formed from the movable contact point disposed on one face of a single rotor coaxially connected to the pivoting shaft so that the single rotor cannot rotate relative to the pivoting shaft, and the fixed contact point provided on an inner face, corresponding to the one face of the rotor, of one of a pair of case halves joined to each other while sandwiching the rotor from opposite sides so as to form a switch case housing the rotor, and the second switch mechanism is formed from the movable contact point disposed on the other face of the rotor and the fixed contact point provided on an inner face of the other case half facing the other face of the rotor.

According to a second aspect of the present invention, in addition to the first aspect, the fixed contact points are formed on a plurality of conductive metal terminal plates insert-bonded to the two case halves, which are made of a synthetic resin, and parts of at least some of the terminal plates project from the case halves so as to form external connection terminals.

According to a third aspect of the present invention, in addition to the second aspect, among the fixed contact points of the first and second switch mechanisms, the terminal plates forming the fixed contact points connected to a power source are joined to each other outside the two case halves.

According to a fourth aspect of the present invention, in addition to the second aspect, a synthetic resin cover member covering at least part of the switch case, which is mounted on a metal body pivotably supporting the pivoting shaft, is mounted on the body, a first coupler half is formed integrally with the body, the first coupler half having a pair of side wall portions sandwiching a plurality of the external connection terminals therebetween and a connecting wall portion connecting the side wall portions and the first coupler half surrounding the external connection terminals on three sides, and a second coupler half is formed integrally with the cover member so as to be detachably fitted into the side wall portions of the first coupler half, the second coupler half forming in cooperation with the first coupler half a coupler that is a cylinder with a rectangular cross section and surrounds the plurality of external connection terminals.

According to a fifth aspect of the present invention, in addition to the fourth aspect, a pair of mating wall portions are provided on the second coupler half so that an inner face of the mating wall portions abuts against an outer face of a partnering coupler when the partnering coupler is fitted into the coupler, the mating wall portions being capable of being fitted into the pair of side wall portions of the first coupler half, and latches are projectingly provided on outer faces of the mating wall portions, the latches being capable of resiliently engaging with the two side wall portions from the inside.

According to a sixth aspect of the present invention, in addition to any one of the first to fifth aspects at least some of the fixed contact points are disposed flush with a sliding surface formed on the case half so that the movable contact point slides against the sliding surface, a grease reservoir is formed on a rear part of the sliding surface, and the sliding surface and the grease reservoir are connected to each other via a connecting hole positioned on a locus, accompanying pivoting of the pivoting shaft, of the movable contact point on a sliding contact area of the sliding surface.

According to a seventh aspect of the present invention, in addition to any one of the first to firth aspects, at lest some of the fixed contact points are disposed flush with a sliding surface formed on the case half so that the movable contact point slides against the sliding surface, a grease reservoir is formed in a rear part of the movable contact point, and a connecting hole is provided in an area, in sliding contact with the sliding surface, of the movable contact point having the grease reservoir formed in the rear part, the connecting hole having an inner end communicating with the interior of the grease reservoir and having an open outer end.

According to an eighth aspect of the present invention, in addition to the first aspect, conductive metal contact point plates having the movable contact points are spring-biased toward a side in which the movable contact points come into contact with the fixed contact points, the conductive metal contact point plates being floatingly supported on the rotor, and a click mechanism imparting a restraining feel to pivoting of the pivoting shaft and the rotor is formed from a guide part and an abutment engagement part, the guide part being formed in at least an arc shape with its center on the axis of the pivoting shaft and having positioning parts provided at a plurality of positions, and the abutment engagement part being provided on the contact point plate so as to abut against the guide part, the abutment engagement part being capable of detachably engaging with the positioning parts.

According to a ninth aspect of the present invention, in addition to the eighth aspect, the abutment engagement part is a rolling body assembled to the contact point plate as a separate body from the contact point plate.

According to a tenth aspect of the present invention, in addition to the eighth aspect, the abutment engagement part is projectingly provided integrally with the contact point plate.

According to an eleventh aspect of the present invention, in addition to the eighth aspect, a cam lobe is provided on the guide part, the cam lobe being formed in a peak shape in which an ascent part and a descent part are connected in sequence along a direction of movement of the rotor in which the movable contact point makes contact with the fixed contact point, the abutment engagement part, which abuts against the cam lobe, is held by the rotor while being spring-biased toward the cam lobe side, and the cam lobe is formed so that the movable contact point starts contacting the fixed contact point during the course of the abutment engagement part ascending the ascent part of the cam lobe, and the movable contact point starts separating from the fixed contact points during the course of the abutment engagement part descending the ascent part.

EFFECTS OF THE INVENTION

In accordance with the first aspect of the present invention, since the movable contact points are disposed on opposite faces of the single rotor, which pivots together with the pivoting shaft, and the fixed contact points are provided on the inner faces of the pair of case halves, which form the switch case, it is possible to reduce the dimensions of the rotary switch device in the radial and axial directions as well as to reduce the number of components.

Furthermore, in accordance with the second aspect of the present invention, since the fixed contact points are each formed on the plurality of conductive metal terminal plates insert-bonded to the synthetic resin case halves, the fixed contact points are firmly fixed to the case halves and, moreover, since parts of at least some of the terminal plates project from the case halves so as to form an external connection terminal, the fixed contact points are easily connected to the exterior.

In accordance with the third aspect of the present invention, since the terminal plates forming the fixed contact points connected to the power source are joined to each other outside the two case halves, a power source connection terminal can be shared by the two case halves.

In accordance with the fourth aspect of the present invention, since half of the coupler, which has the rectangular cross section, is formed from the first coupler half formed integrally with the metal body, and the remaining half of the coupler is formed from the second coupler half formed integrally with the synthetic resin cover member covering at least part of the switch case, it is possible to form the coupler while reducing the dimensions of the switch case and, moreover, since the first coupler half is made of metal, it is possible to increase the strength of the coupler.

In accordance with the fifth aspect of the present invention, it becomes easy to assemble the second coupler half to the first coupler half and, moreover, when the partnering coupler is fitted into the coupler, since the inner faces of the pair of mating wall portions of the second coupler half abut against the outer faces of the partnering coupler, a state in which the two mating wall portions are fitted into the two side wall portions is firmly maintained.

In accordance with the sixth or seventh aspect of the present invention, each time the movable contact point slides on the sliding surface, an oil component of the grease retained in the grease reservoir is supplied to the area of sliding contact between the movable contact point and the sliding surface via the connecting hole and the oil component is spread out over the sliding locus of the movable contact point. In this process, the thickness of an oil film over the sliding locus is substantially uniform by virtue of surface tension, and the amount of grease supplied is automatically adjusted in accordance with the amount of grease consumed by self-heating due to arc dissociation or Joule heating. Therefore, regardless of the extent of the electrical load and the number of times of repetition, an appropriate amount of grease is always maintained over the sliding locus, and it becomes possible to maintain insulation and durability for a long period of time by maintaining an appropriate amount of grease between the movable contact point and the fixed contact point while making it unnecessary to increase the distance between the contact points, thereby reducing the dimensions of the rotary switch device.

In accordance with the eighth aspect of the present invention, since the click mechanism is provided between the contact point plate that has the movable contact point and is floatingly supported on the rotor and the switch case housing the rotor, it is possible to accurately position the contact point plate, that is, the movable contact point, at a predetermined pivot position, it is therefore unnecessary to make up for backlash of the contact point plate relative to the rotor by the size of the contact point plate, and since there is no need to form a large contact point plate, it is possible to avoid any increase in the dimensions of the rotary switch device.

In accordance with the ninth aspect of the present invention, since the abutment engagement part is the rolling body, it is possible to reduce frictional loss when the abutment engagement part moves while abutting against the guide part.

In accordance with the tenth aspect of the present invention, since the abutment engagement part is integral with the contact point plate, it is possible to reduce the number of components.

Furthermore, in accordance with the eleventh aspect of the present invention, when a constant operating force acts on the rotor so as to move the rotor toward a side on which the movable contact point comes into contact with the fixed contact point and the abutment engagement part ascends the ascent part of the cam lobe, since the spring force that urges the abutment engagement part so as to make it abut against the cam lobe gradually increases, the speed when the movable contact point starts contacting the fixed contact point in the course of the abutment engagement part ascending the ascent part becomes relatively slow, and when the rotor is moved to a side on which the movable contact point separates from the fixed contact point and the abutment engagement part descends the ascent part of the cam lobe, since the spring force that urges the abutment engagement part so as to make it abut against the cam lobe gradually decreases, the speed when the movable contact point starts separating from the fixed contact point in the course of the abutment engagement part descending the ascent part becomes relatively fast. That is, it is possible to decrease the speed when the movable contact point starts contacting the fixed contact point and increase the speed of separation of the movable contact point from the fixed contact point, and it is therefore possible to prevent the occurrence of any adverse influence on contact point performance accompanying opening and closing of the movable contact point and the fixed contact point.

EXPLANATION OF REFERENCE NUMERALS AND SYMBOLS

Figure 1:
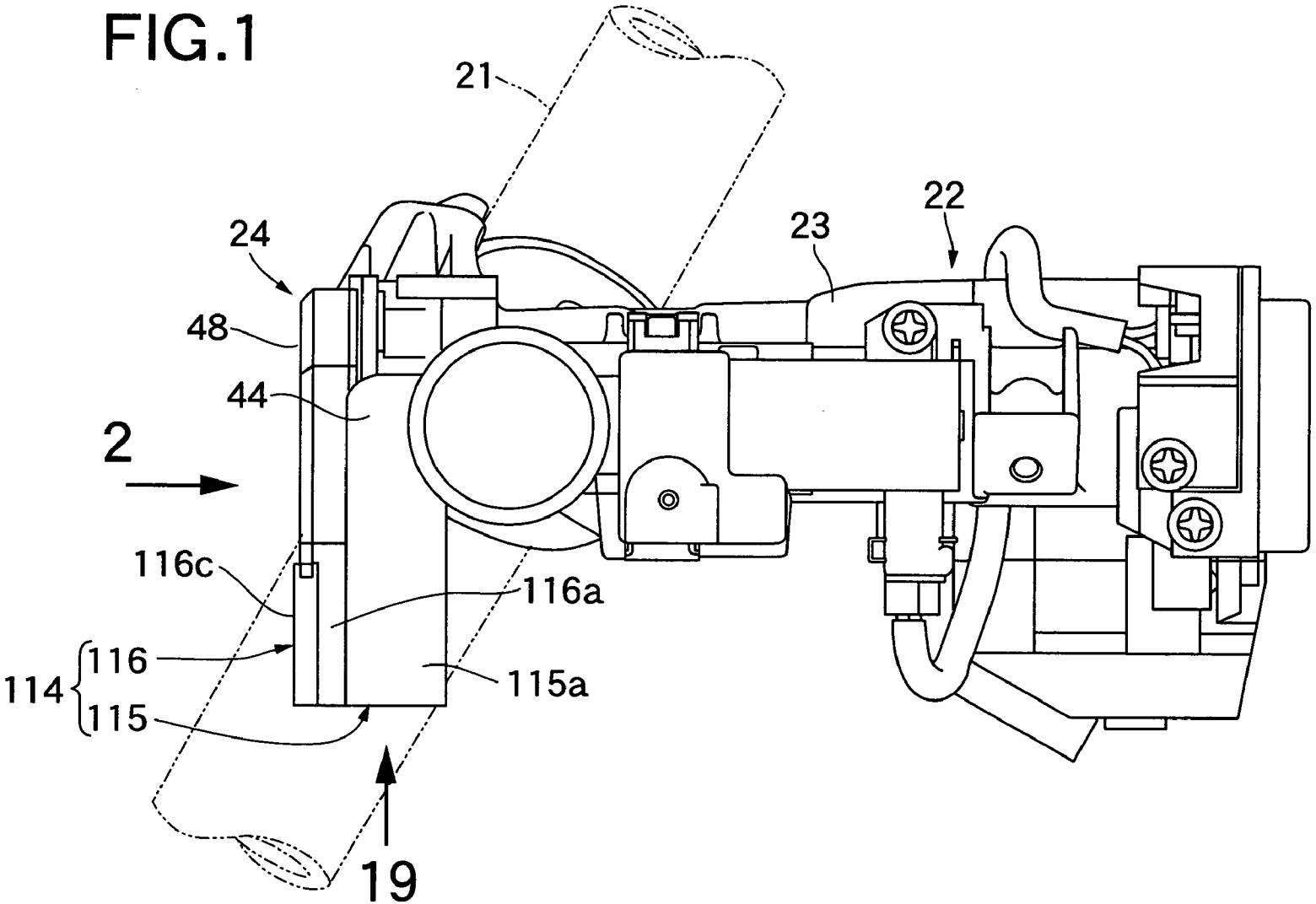
FIG. 1 is a side view of a steering lock device and an ignition switch of a first embodiment (first embodiment).

23 Body
25 Pivoting Shaft
26 First Switch Mechanism
27 Second Switch Mechanism
28 Rotor
29 Switch Case
30 First Case Half
31 Second Case Half
48 Cover Member
65, 66, 67, 68, 85, 86, 87, 88 Movable Contact Point
69, 70, 71, 72, 89, 90, 91, 92 Fixed Contact Point
73, 73', 74, 74', 93, 93', 94, 94' Contact Point Plate
76, 77, 78; 96, 97, 98 Terminal Plate
106, 107, 108, 109, 110 External Connection terminal
112, 113 Sliding Surface
115 First Coupler Half
115*a*, 115*b* Side Wall Portion
115*c* Connecting Wall Portion
116 Second Coupler Half
116*a*, 116*b* Mating Wall Portion
117, 118 Latch
121 Partnering Coupler
124, 138 Click Mechanism
125, 139 Guide part
126, 140 Rolling Body As Abutment Engagement part
130, 131, 132; 143, 144, 145 Positioning Part
133, 134, 147 Cam Lobe
133*a*, 134*a*; 147*a* Ascent Part
133*b*, 134*b*, 147*b* Descent Part
151, 154, 159 Grease reservoir
152, 155, 160 Connecting Hole
157 Abutment Engagement part
C1, C2 Locus

BEST MODE FOR CARRYING OUT THE INVENTION

Modes for carrying out the present invention are explained below by reference to embodiments of the present invention shown in the attached drawings.

Embodiment 1

A first embodiment of the present invention is explained by reference to FIG. 1 to FIG. 21; firstly in FIG. 1 and FIG. 2, mounted on a steering column 21 is a metal body 23 of a steering lock device 22, and mounted on a rear part of the body 23 is an ignition switch 24 as a rotary switch device that changes switching mode according to a key (not illustrated) being operated to each of a LOCK position, an ACC position, an ON position, and a START position, thus controlling starting/stopping of a vehicular engine and an electrical component.

Figure 3:
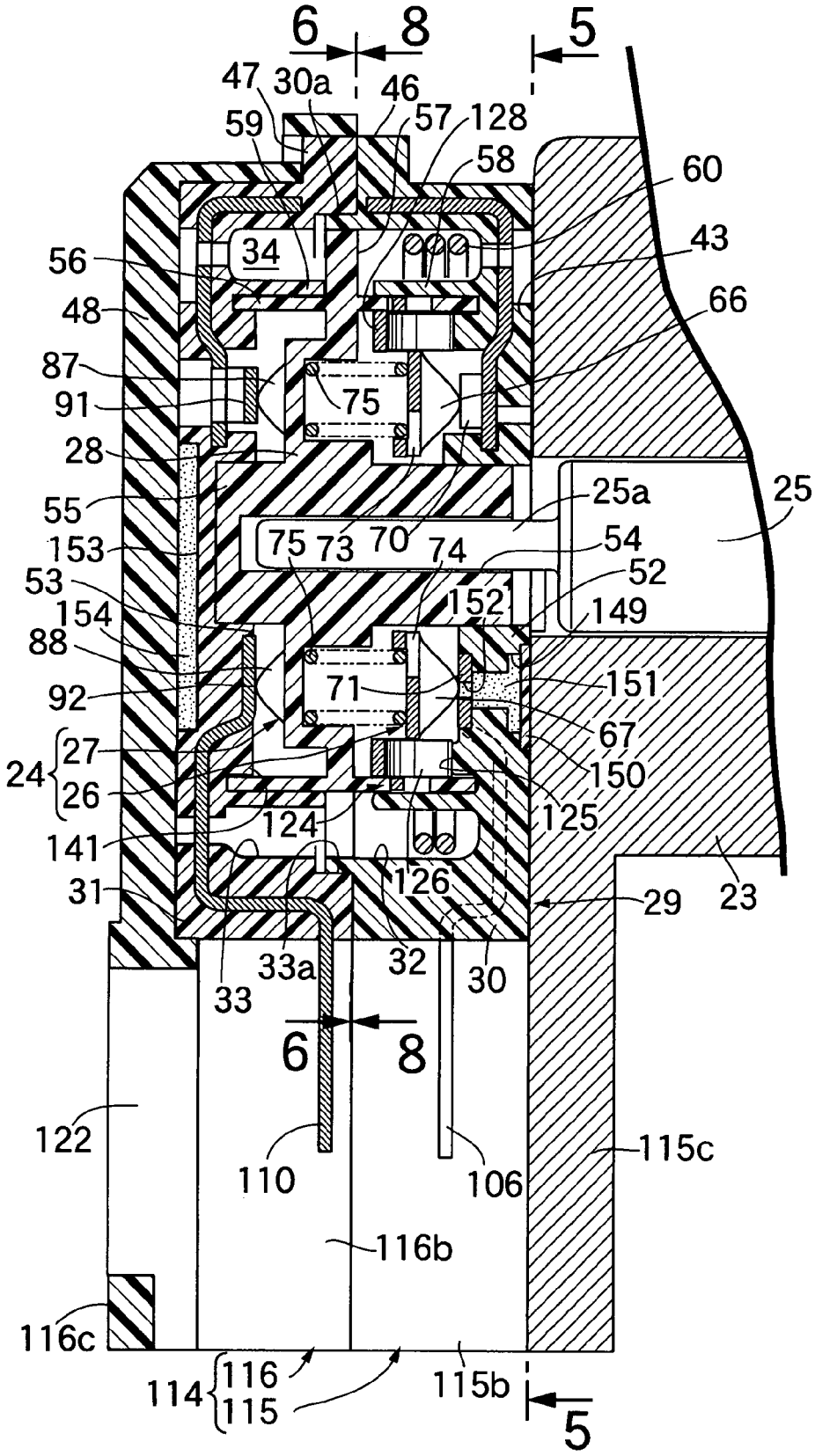
FIG. 3 is an enlarged sectional view along line 3-3 in FIG. 2 (first embodiment).
Figure 4:
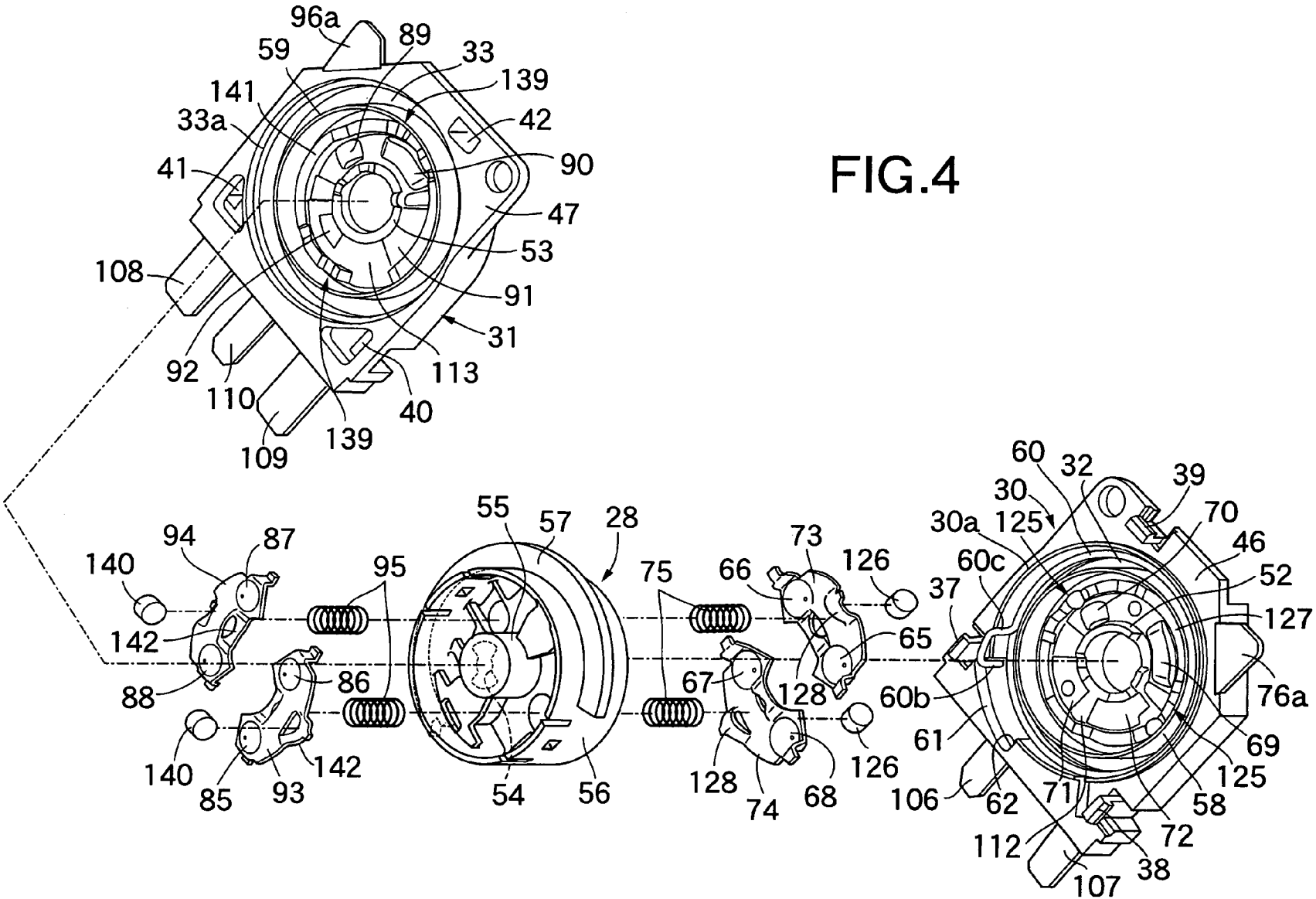
FIG. 4 is an exploded perspective view of the ignition switch (first embodiment).

In FIG. 3, a pivoting shaft 25 that pivots according to the key operation is pivotably supported on the body 23, and the ignition switch 24 is provided with first and second switch mechanisms 26 and 27 that change the switching mode in response to pivoting of the pivoting shaft 25.

A rotor 28 made of a single synthetic resin is connected to the pivoting shaft 25 so that the rotor 28 cannot pivot relative thereto, this rotor 28 is housed within a switch case 29 formed from first and second case halves 30 and 31 joined to each other with the rotor 28 sandwiched therebetween, and the switch case 29 is mounted on the rear part of the body 23.

In FIG. 4 to FIG. 9, among the first and second case halves 30 and 31, the first case half 30, which is disposed on the body 23 side, is provided with a circular recess 32 opening on the second case half 31 side, and the second case half 31 is provided with a circular recess 33 opening on the first case half 30 side. Furthermore, the first case half 30 is provided integrally with a ring-shaped mating projection 30*a* forming part of the circular recess 32 and projecting toward the second case half 31 side, and this mating projection 30*a* is fitted into a mating recess 33*a* provided at an open end of the recess 33 of the second case half 31.

When the first and second case halves 30 and 31 are joined to each other to form the switch case 29, the recesses 32 and 33 form in cooperation a circular operating chamber 34, and the rotor 28 is housed in the operating chamber 34.

Figure 10:
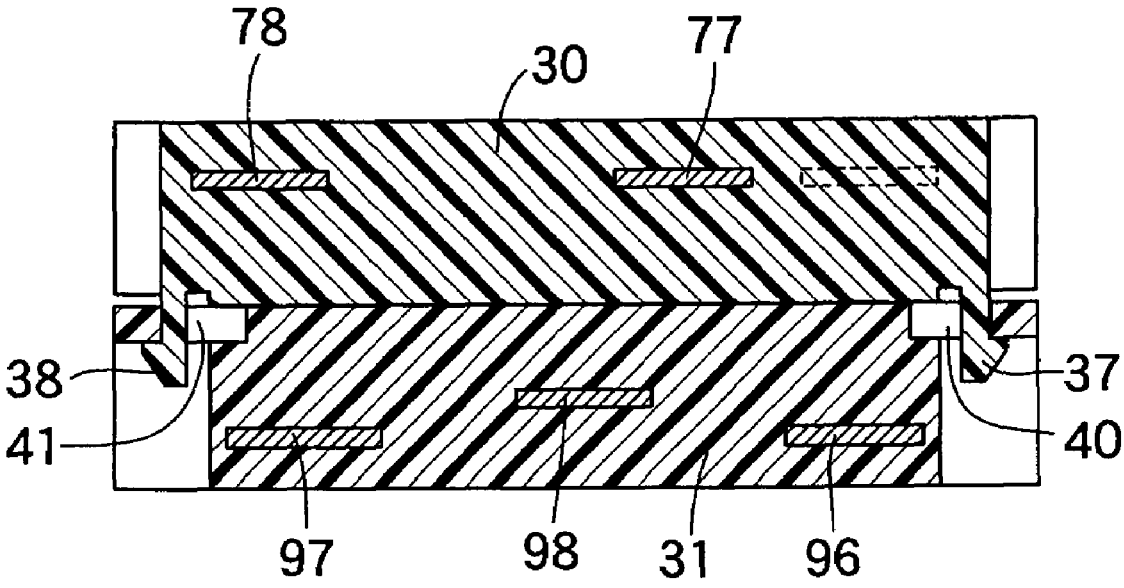
FIG. 10 is a sectional view along line 10-10 in FIG. 5 (first embodiment).
Figure 11:
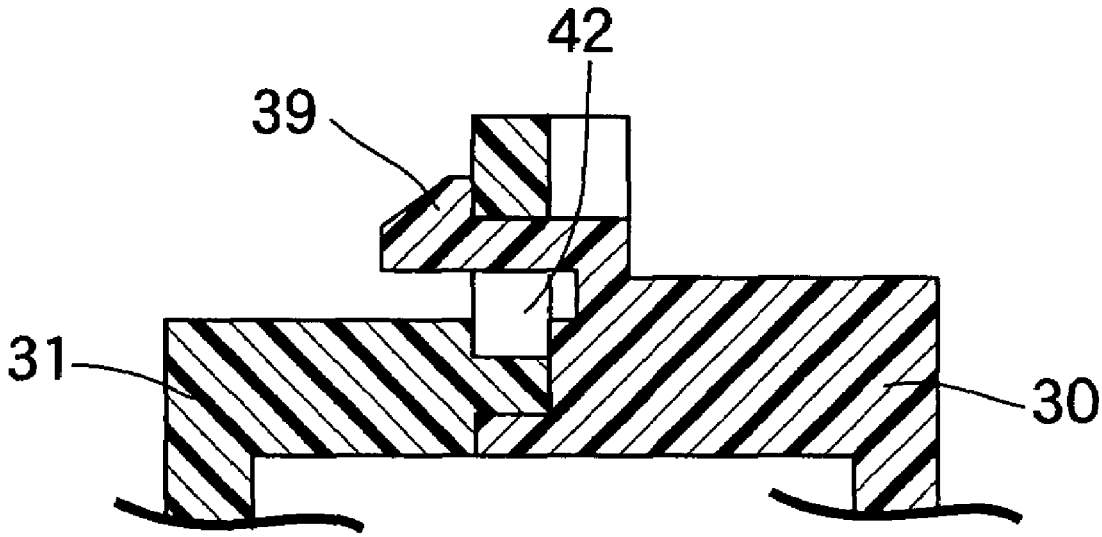
FIG. 11 is a sectional view along line 11-11 in FIG. 5 (first embodiment).

Referring in addition to FIG. 10 and FIG. 11, latches 37, 38, and 39 extending toward the second case half 31 side and having their extremities bent outward in a hook shape are integrally provided so as to be connected to a peripheral part of the first case half 30 at three positions spaced in the peripheral direction, and the second case half 31 is provided with engagement holes 40, 41, and 42 through which the latches 37, 38, and 39 are respectively passed. By making the latches 37 to 39 passed through the engagement holes 40 to 42 resiliently engage with the second case half 31, the first and second case halves 30 and 31 are joined to each other to thus form the switch case 29.

Figure 2:
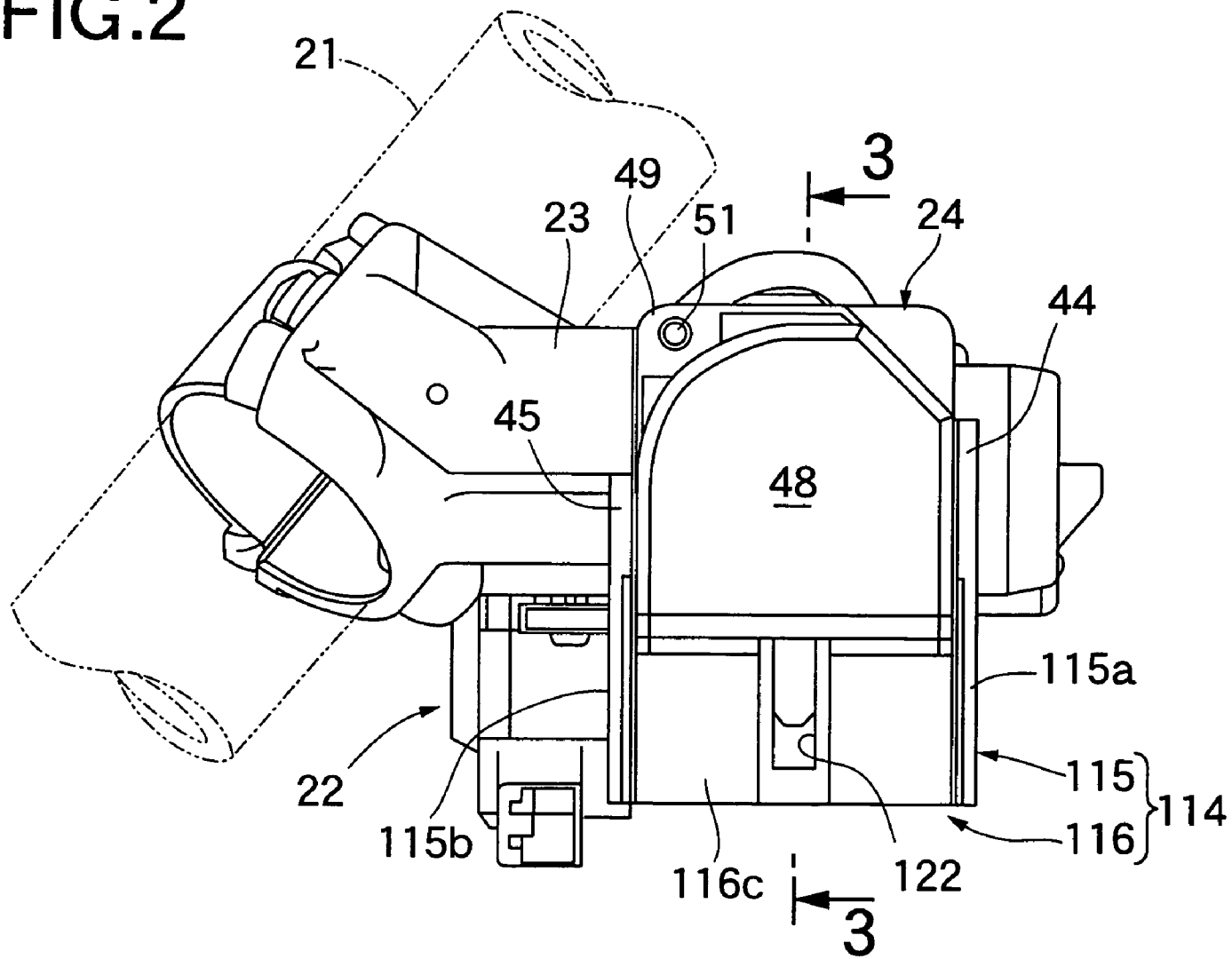
FIG. 2 is an enlarged view from arrow 2 in FIG. 1 (first embodiment).
Figure 5:
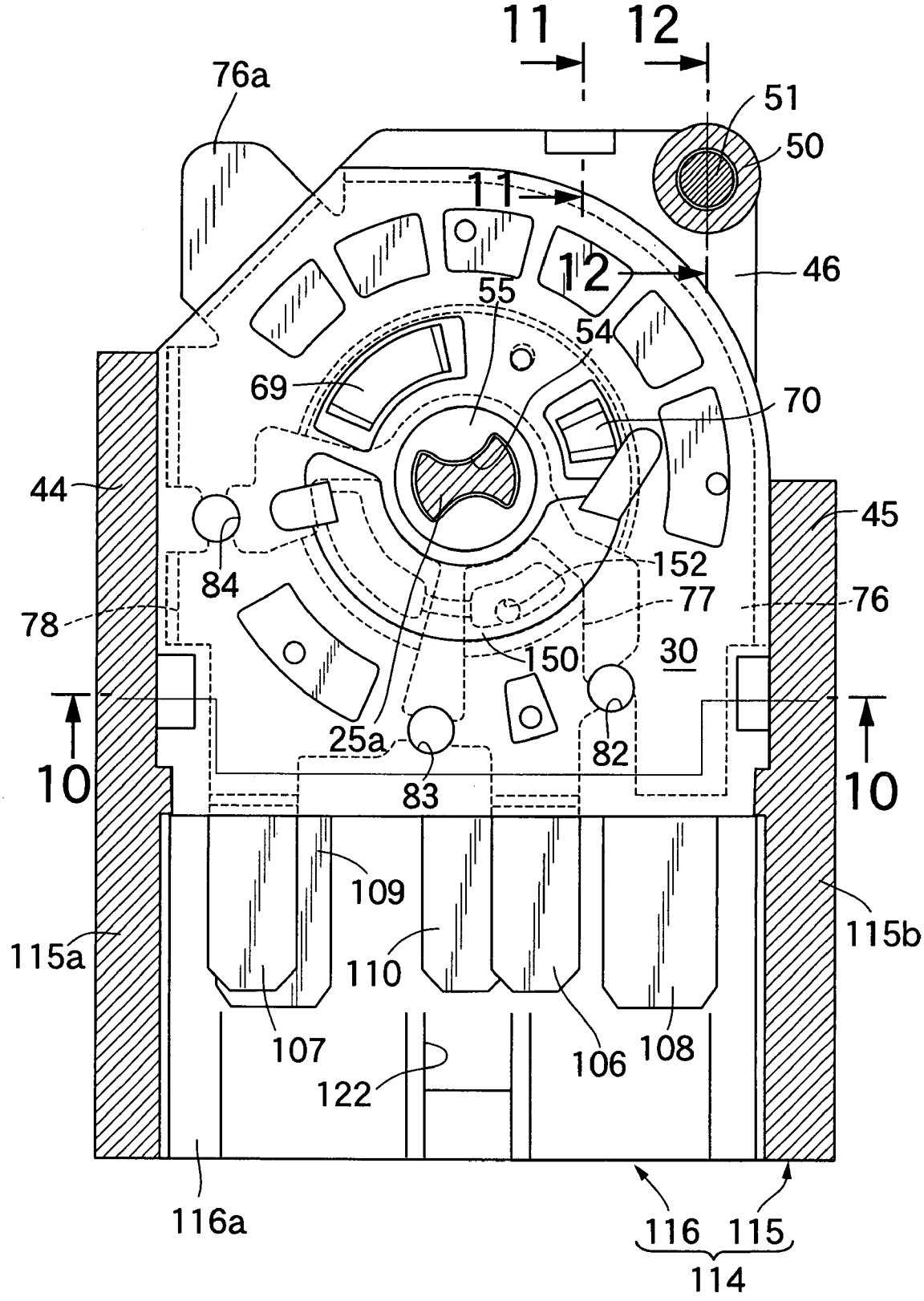
FIG. 5 is a sectional view along line 5-5 in FIG. 3 (first embodiment).
Figure 6:
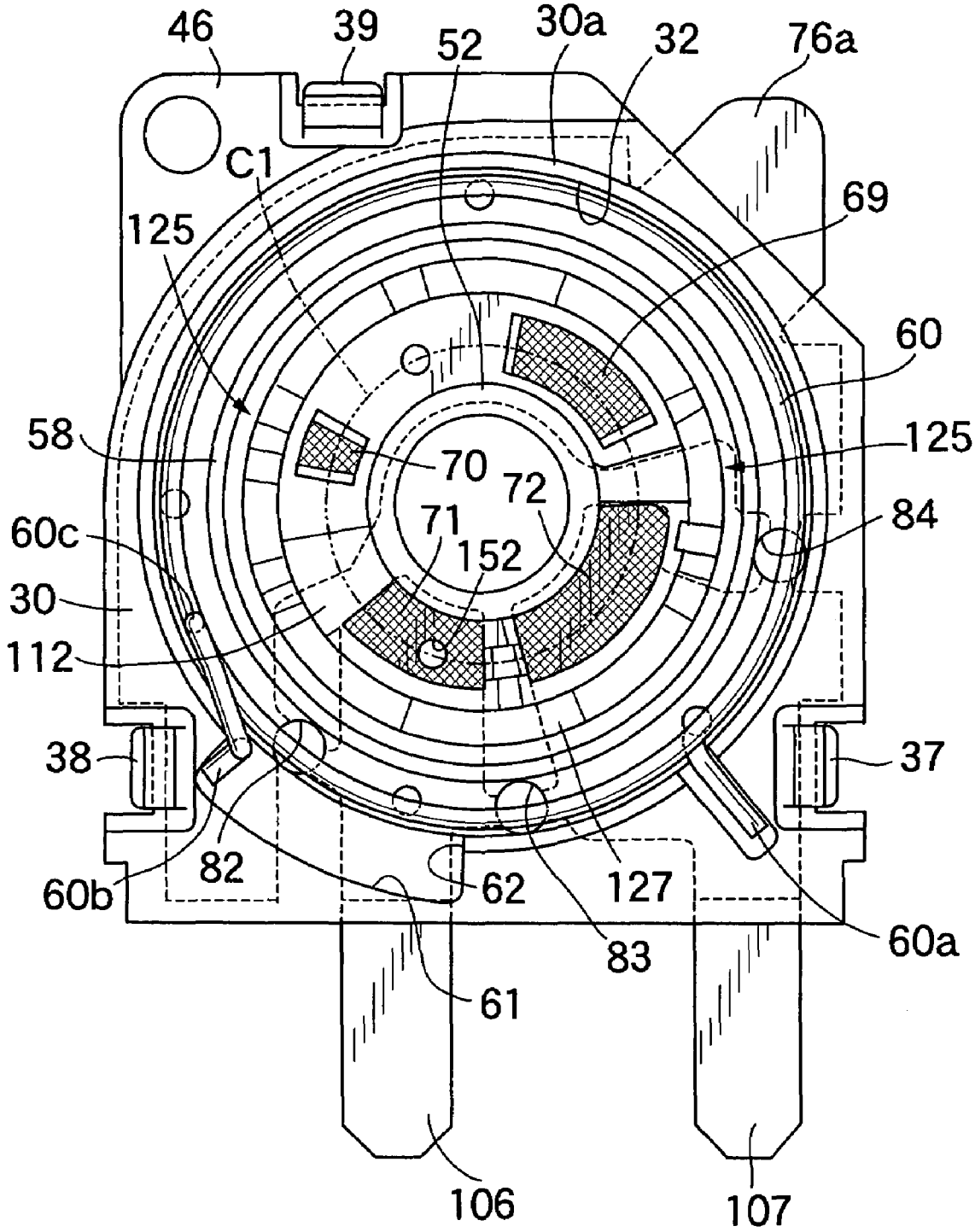
FIG. 6 is a view of a first case half from the direction of arrowed line 6-6 in FIG. 3 (first embodiment).

On the rear part of the body 23, there is formed a support face 43 (see FIG. 3) having the switch case 29 abutting thereagainst, and there are provided, as shown in FIG. 1, FIG. 2, and FIG. 5, a pair of left and right support walls 44 and 45 sandwiching part of the first case half 30 of the switch case 29 from opposite sides.

Figure 12:
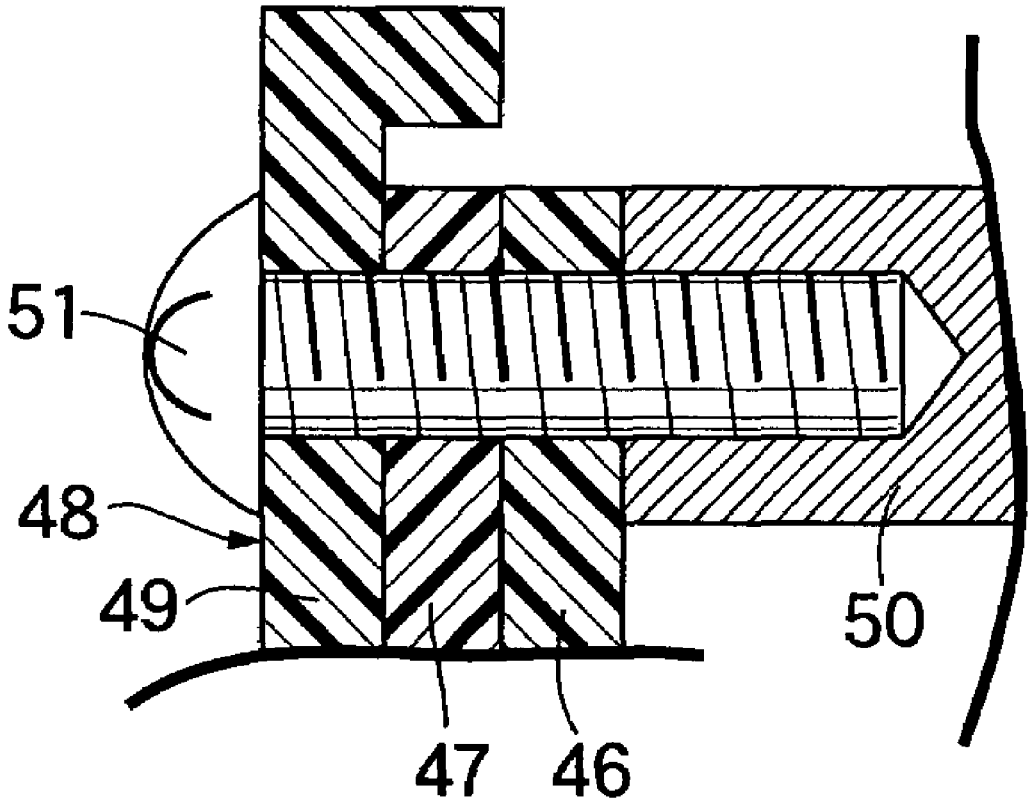
FIG. 12 is a sectional view along line 12-12 in FIG. 5 (first embodiment).

Upper parts of the first and second case halves 30 and 31 are provided integrally with support collar parts 46 and 47 that are superimposed on each other and project outward. Furthermore, the second case half 31 of the switch case 29 is covered by a synthetic resin cover member 48; this cover member 48 is provided, as shown in FIG. 12, with a support collar part 49 that abuts against the support collar part 47 of the second case half 31 from the outside, and the body 23 is provided integrally with a cylindrical boss 50 projecting from the support face 43 and abutting against the support collar part 46 of the first case half 30. Furthermore, a screw member 51 inserted through the support collar parts 49, 47, and 46 is screwed into the boss 50, and by tightening the screw member 51 the switch case 29 is mounted on the body 23 together with the cover member 48, the switch case 29 abutting against the support face 43 and having lateral movement restricted by the support walls 44 and 45.

Figure 13:
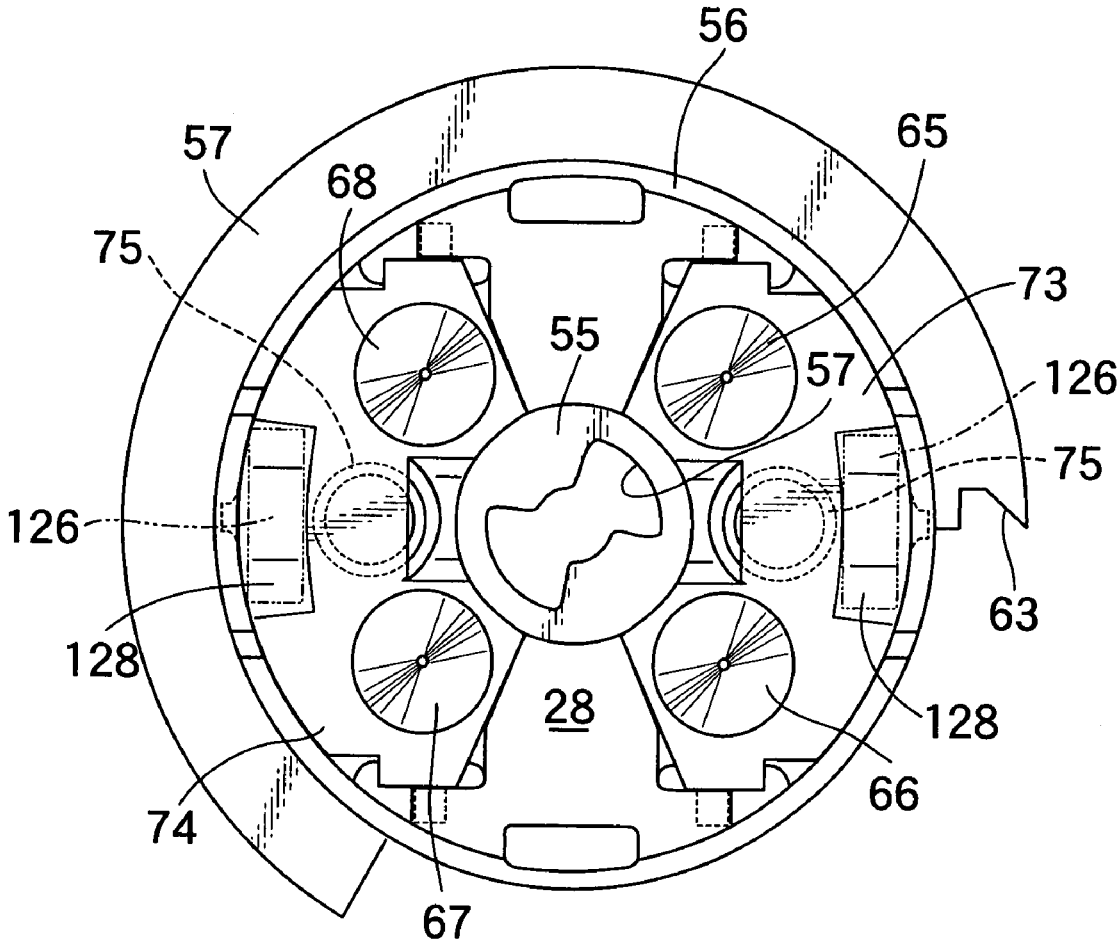
FIG. 13 is a view of a rotor from the first case half side (first embodiment).
Figure 14:
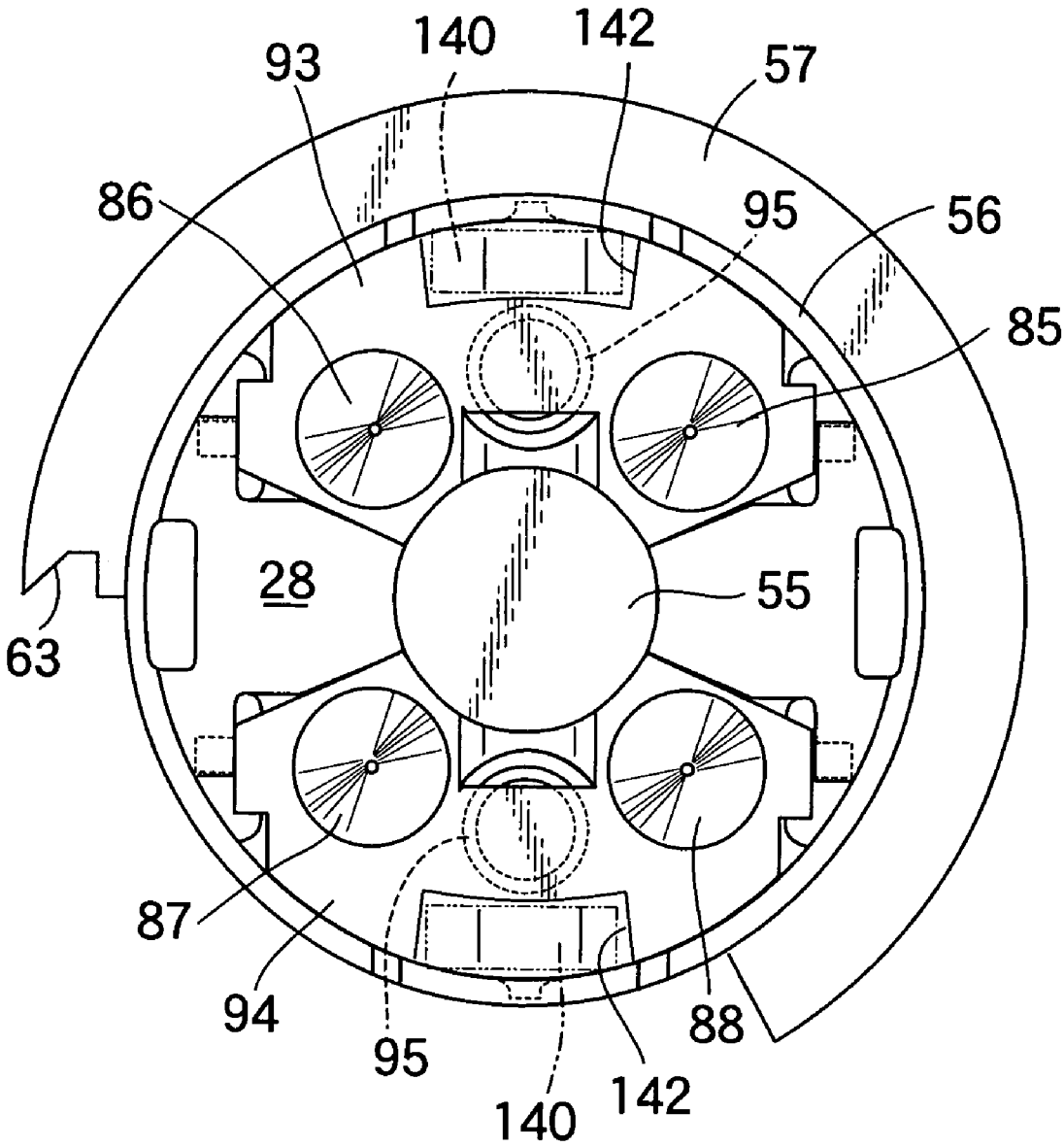
FIG. 14 is a view of the rotor from the second case half side (first embodiment).

In FIG. 13 and FIG. 14, the rotor 28 is provided integrally with a shaft part 55 having the same axis as that of the rotor 28 and projecting from opposite faces of the rotor 28. Furthermore, provided on a middle part of the first case half 30 is a cylindrical support tube part 52, having opposite ends open, into which is pivotably fitted one end part of the shaft part 55, and provided on a middle part of the second case half 31 is a bottomed cylindrical support tube part 53 into which is pivotably fitted the other end of the shaft part 55. Moreover, the shaft part 55 is provided with a bottomed engagement hole 54 opening on said one end side so as to have a noncircular cross section, and an engagement shaft portion 25*a* provided coaxially and integrally so as to be connected to an end part of the pivoting shaft 25 is inserted into the engagement hole 54. Moreover, the engagement shaft portion 25*a* has a cross section that corresponds to the cross section of the engagement hole 54, and the pivoting shaft 25 is thereby coupled to the shaft part 55, that is, the rotor 28, so that the pivoting shaft 25 cannot pivot relative thereto.

Furthermore, the rotor 28 is provided integrally with a cylindrical sliding tube part 56 coaxially surrounding the shaft part 55 and a collar part 57 protruding radially outward from the sliding tube part 56 and having part in the peripheral direction cut out, and the first and second case halves 30 and 31 are provided with cylindrical inner tube parts 58 and 59 having the sliding tube part 56 slidably fitted thereinto and sandwiching a base portion of the collar part 57 from opposite sides.

A coil-shaped torsion spring 60 is housed between the inner periphery of the recess 32 and the outer periphery of the inner tube part 58 of the first case half 30, and an engagement part 60*a* provided at one end of the torsion spring 60 is engaged with the first case half 30. Provided on a face of the first case half 30 via which it is joined to the second case half 31 is a restricting recess 61 that is formed in an arc shape having its center on an axis of the recess 32 and that communicates with an open end of the recess 32 via a notch 62 provided in the mating projection 30*a*, and disposed within the restricting recess 61 is a restricting pin portion 60*b* provided at the other end part of the torsion spring 60 so that the restricting pin portion 60*b* can move within the restricting recess 61.

A latching portion 60*c* is provided in a portion, close to the restricting pin portion 60*b*, of the torsion spring 60, and an engagement part 63 is provided at one end in the peripheral direction of the collar part 57 of the rotor 28, the engagement part 63 engaging with the latching portion 60*c* when the pivoting shaft 25, that is, the rotor 28, pivots from the LOCK position to the ON position via the ACC position. When the rotor 28 pivots from the ON position to the START position side, it is necessary to pivot the rotor 28 against the spring force of the torsion spring 60 due to the engagement part 63 engaging with the latching portion 60*c*, and when the operating force imposed on the rotor 28 is released, since the spring force of the torsion spring 60 is acting on the rotor 28, the rotor 28 is automatically returned from the START position to the ON position.

The first switch mechanism 26 is provided between one face of the rotor 28 and the first case half 30, and includes movable contact points 65, 66, 67, and 68, which are disposed on said one face of the rotor 28, and power source fixed contact points 69 and 70, an IG2 fixed contact point 71, and an ACC fixed contact point 72, which are provided on the first case half 30. Here, the power source fixed contact points 69 and 70, the IG2 fixed contact point 71, and the ACC fixed contact point 72 are shown by hatching in FIG. 6 for ease of identification.

The movable contact points 65 and 66 are formed in a conical shape projecting toward the first case half 30 side from opposite end parts of a contact point plate 73 disposed around the shaft part 55, and the movable contact points 67 and 68 are formed in a conical shape projecting toward the first case half 30 side from opposite end parts of a contact point plate 74 disposed around the shaft part 55; the two contact point plates 73 and 74 including the movable contact points 65, 66; 67, 68 are formed symmetrically with respect to a point on the axis of the shaft part 55, and the movable contact points 65 to 68 are disposed on said one face of the rotor 28 at intervals of 90 degrees around the axis of the shaft part 55.

The two contact point plates 73 and 74 are urged by springs 75 toward the first case half 30 side and are floatingly supported on the rotor 28 so that the positions thereof relative to the rotor 28 in the peripheral direction are restricted but relative movement within a restricted range in the axial direction is allowed. That is, the movable contact points 65 to 68 are floatingly supported on the rotor 28 while being spring-biased toward the first case half 30 side.

Figure 15:
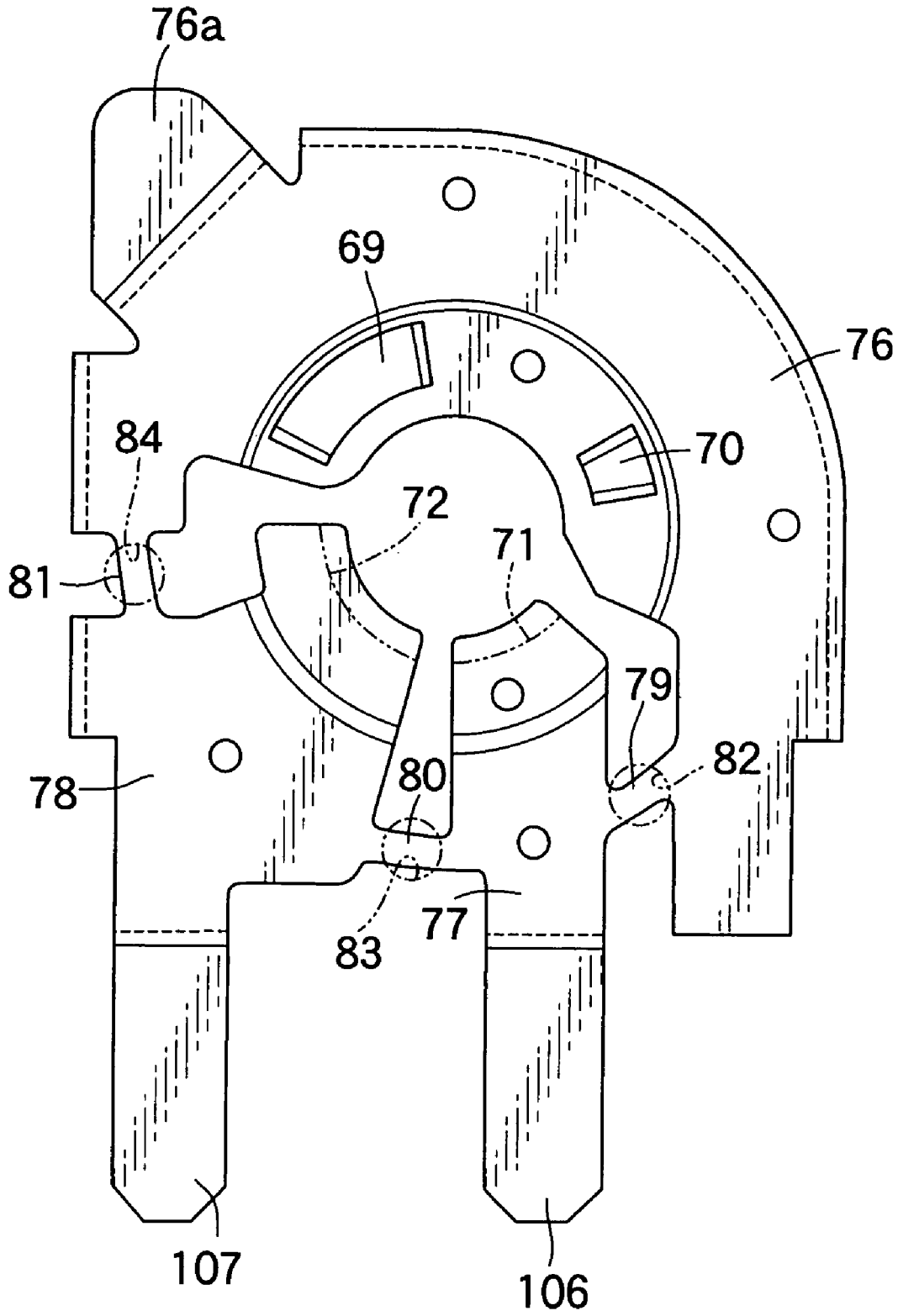
FIG. 15 is a diagram showing a connected state of a terminal plate forming a fixed contact point of a first switch mechanism (first embodiment).

The power source fixed contact points 69 and 70 are formed by uplifting parts of a conductive metal terminal plate 76, and the IG2 fixed contact point 71 and the ACC fixed contact point 72 are formed from parts of conductive metal terminal plates 77 and 78. Moreover, the terminal plates 76, 77, and 78 are insert-bonded when die-molding the synthetic resin first case half 30; as shown in FIG. 15, prior to insert-bonding, the terminal plates 76 to 78 are connected together as a unit via bridging parts 79, 80, and 81, and after completion of die-molding of the first case half 30 each of the bridging parts 79 to 81 is punched out. That is, immediately after the first case half 30 is die-molded with the terminal plates 76 to 78 insert-bonded, recesses are formed in opposite faces of the first case half 30 so that front and back faces of each of the bridging parts 79 to 81 are exposed to the exterior, and by punching out a portion of each of the bridging parts 79 to 81 facing the corresponding recesses so as to form punched holes 82, 83, and 84, each of the bridging parts 79 to 81 is severed. By punching out each of the bridging parts 79 to 81 after completion of die-molding of the first case half 30, the terminal plates 76 to 78 are disposed on the first case half 30 in a state in which they are electrically disconnected from each other.

The IG2 fixed contact point 71 and the ACC fixed contact point 72 are spaced and disposed flush with a sliding surface 112 formed around the support tube part 52 so that the movable contact points 65 to 68 on the rotor 28 side slide thereagainst, and the power source fixed contact points 69 and 70 are disposed so as to be spaced from the sliding surface 112 as well as spaced from each other. Moreover, the power source fixed contact points 69 and 70, the IG2 fixed contact point 71, and the ACC fixed contact point 72 are disposed on a locus C1 taken, accompanying pivoting of the rotor 28, by each of the movable contact points 65 to 68 on one flat face that is perpendicular to the pivotal axis of the rotor 28, and a section between the power source fixed contact point 69 and the ACC fixed contact point 72, a section between the two power source fixed contact points 69 and 70, and a section between the power source fixed contact point 70 and the IG2 fixed contact point 71 are made concave so as to be further away from the rotor 28 than the sliding surface 112.

The second switch mechanism 27 is provided between the other face of the rotor 28 and the second case half 31, and includes movable contact points 85, 86, 87, and 88, which are disposed on said other face of the rotor 28, and power source fixed contact points 89 and 90, an IG1 fixed contact point 91, and a START fixed contact point 92, which are provided on the second case half 31. Here, the power source fixed contact points 89 and 90, the IG1 fixed contact point 91, and the START fixed contact point 92 are shown by hatching in FIG. 8 for ease of identification.

The movable contact points 85 and 86 are formed in a conical shape projecting toward the second case half 31 side from opposite end parts of a contact point plate 93 disposed around the shaft part 55, and the movable contact points 87 and 88 are formed in a conical shape projecting toward the second case half 30 side from opposite end parts of a contact point plate 94 disposed around the shaft part 55; the two contact point plates 93 and 94 are formed symmetrically with respect to a point on the axis of the shaft part 55, and the movable contact points 85 to 88 are disposed on said other face of the rotor 28 at intervals of 90 degrees around the axis of the shaft part 55. Moreover, the movable contact points 85 to 88 are disposed at positions that are 90 degree out of phase with the movable contact points 65 to 68 of the first switch mechanism 26.

The two contact point plates 93 and 94 are urged by springs 95 toward the second case half 31 side and are floatingly supported on the rotor 28 so that the positions thereof relative to the rotor 28 in the peripheral direction are restricted but relative movement within a restricted range in the axial direction is allowed. That is, the movable contact points 85 to 88 are floatingly supported on the rotor 28 while being spring-biased toward the second case half 31 side.

Figure 16:
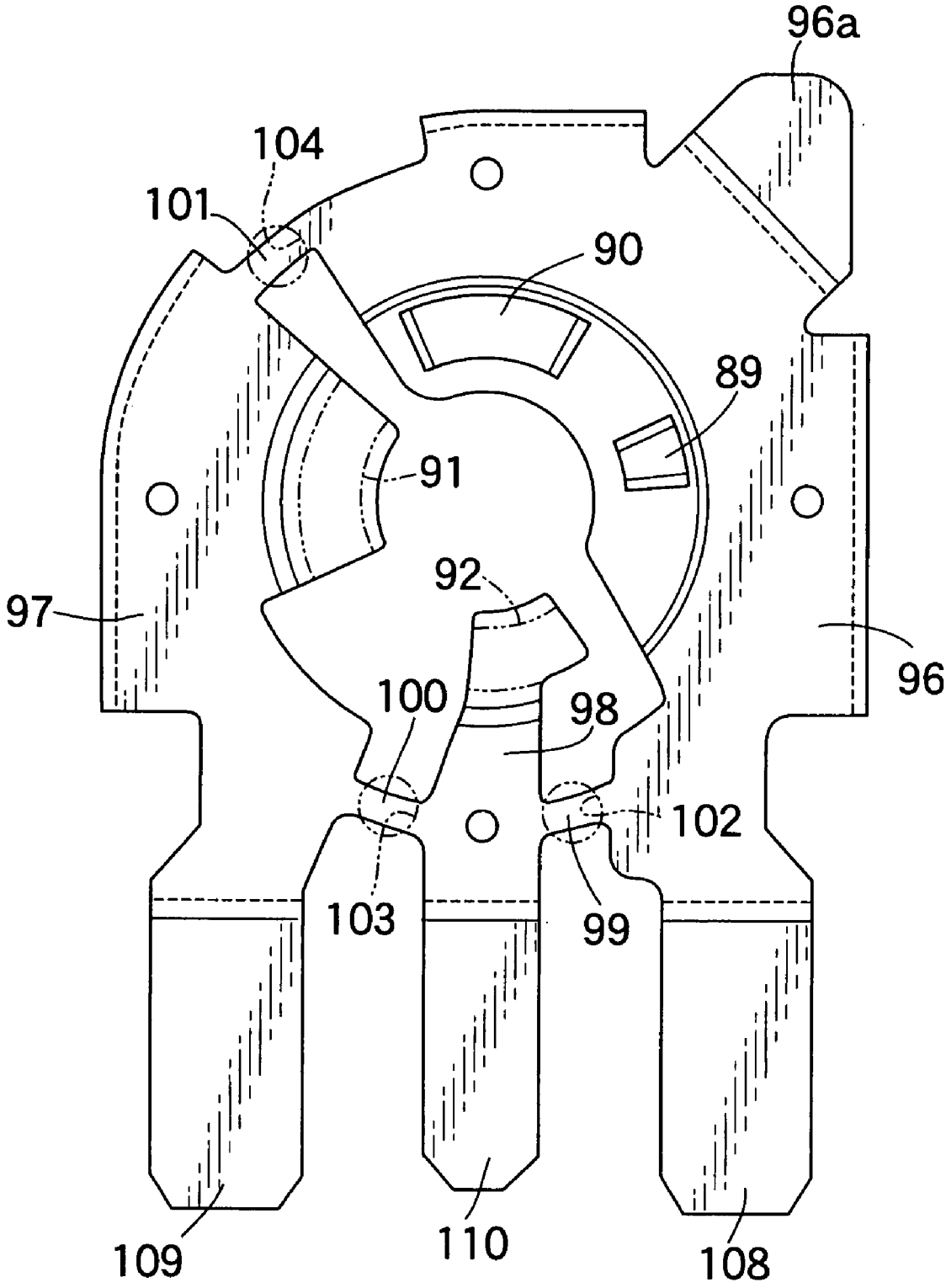
FIG. 16 is a diagram showing a connected state of a terminal plate forming a fixed contact point of a second switch mechanism (first embodiment).

The power source fixed contact points 89 and 90 are formed by uplifting parts of a conductive metal terminal plate 96, and the IG1 fixed contact point 91 and the START fixed contact point 92 are formed from parts of conductive metal terminal plates 97 and 98. Moreover, the terminal plates 96 to 98 are insert-bonded when die-molding the synthetic resin second case half 31; as shown in FIG. 16, prior to insert-bonding, the terminal plates 96 to 98 are connected together as a unit via bridging parts 99, 100, and 101, and after completion of die-molding of the second case half 31 each of the bridging parts 99 to 101 is punched out. That is, immediately after the second case half 31 is die-molded with the terminal plates 96 to 98 insert-bonded, recesses are formed in opposite faces of the second case half 31 so that front and back faces of each of the bridging parts 99 to 101 are exposed to the exterior, and by punching out a portion of each of the bridging parts 99 to 101 facing the corresponding recesses so as to form punched holes 102, 103, and 104, each of the bridging parts 96 to 98 is severed. By punching out each of the bridging parts 96 to 98 after completion of die-molding of the second case half 31, the terminal plates 96 to 98 are disposed on the second case half 31 in a state in which they are electrically disconnected from each other.

The IG1 fixed contact point 91 and the START fixed contact point 92 are spaced and disposed flush with a sliding surface 113 formed around the support tube part 53 so that the movable contact points 85 to 88 on the rotor 28 side slide thereagainst, and the power source fixed contact points 89 and 90 are disposed so as to be spaced from the sliding surface 113 as well as spaced from each other. Moreover, the power source fixed contact points 89 and 90, the IG1 fixed contact point 91, and the START fixed contact point 92 are disposed on a locus C2 (the same as the locus C1) taken, accompanying pivoting of the rotor 28, by each of the movable contact points 85 to 88 on one flat face that is perpendicular to the pivotal axis of the rotor 28, and a section between the power source fixed contact point 89 and the START fixed contact point 92, a section between the two power source fixed contact points 89 and 90, and a section between the power source fixed contact point 90 and the IG1 fixed contact point 91 are made concave so as to be further away from the rotor 28 than the sliding surface 113.

Figure 17:
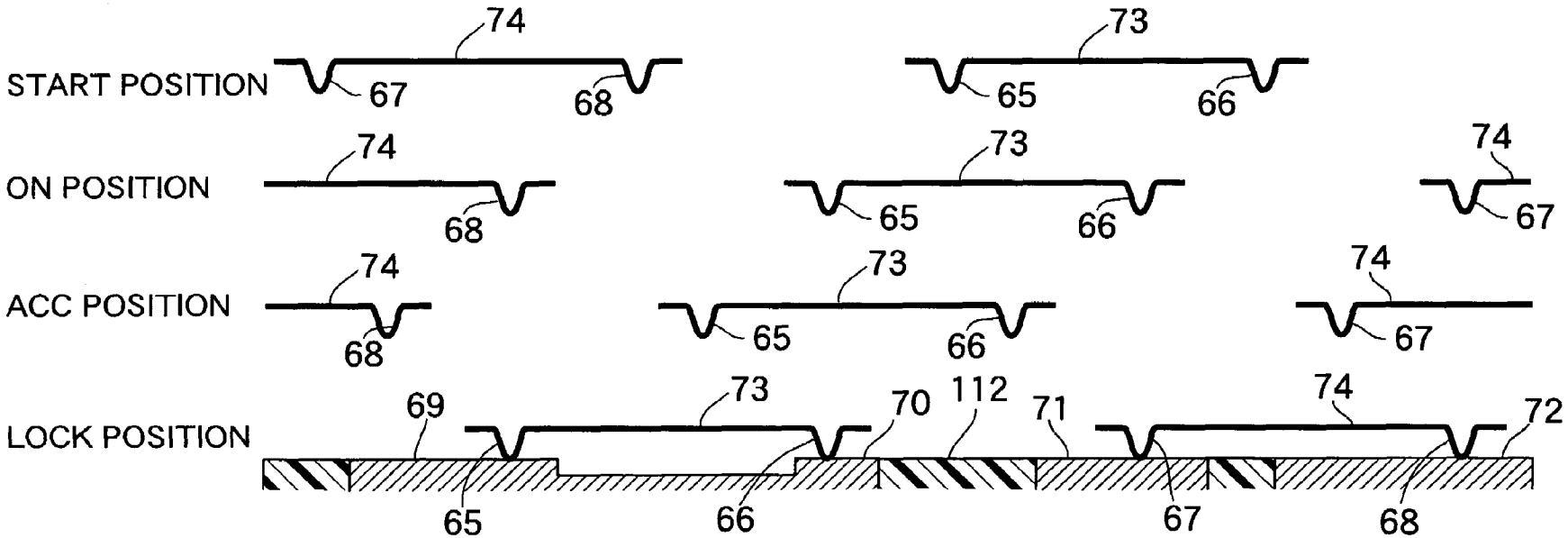
FIG. 17 is a diagram showing relative positions of a movable contact point and the fixed contact point of the first switch mechanism (first embodiment).

In the first switch mechanism 26, positioning of the movable contact points 65 to 68 relative to the power source fixed contact points 69 and 70, the IG2 fixed contact point 71, and the ACC fixed contact point 72 when the rotor 28 pivots to the LOCK position, the ACC position, the ON position, and the START position in sequence are as shown in FIG. 17.

In accordance with FIG. 17, in the LOCK position, the movable contact points 65 and 66 are in contact with the power source fixed contact points 69 and 70, and the movable contact points 67 and 68 are in contact with the IG2 fixed contact point 71 and the ACC fixed contact point 72; in the ACC position, the movable contact points 65 and 66 are not in contact with any of the fixed contact points whereas the movable contact points 67 and 68 are in contact with the ACC fixed contact point 72 and the power source fixed contact point 69; in the ON position, the movable contact points 65 and 66 are in contact with the power source fixed contact point 70 and the IG2 fixed contact point 71, and the movable contact points 67 and 68 are in contact with the ACC fixed contact point 72 and the power source fixed contact point 69; and in the START position, the movable contact points 65, 66; 67, 68 are not in contact with any of the fixed contact points. That is, in the first switch mechanism 26, in the ACC position the ACC fixed contact point 72 is connected to the power source fixed contact point 69, and in the ON position the ACC fixed contact point 72 is connected to the power source fixed contact point 69, and the IG2 fixed contact point 71 is connected to the power source fixed contact point 70.

Figure 18:
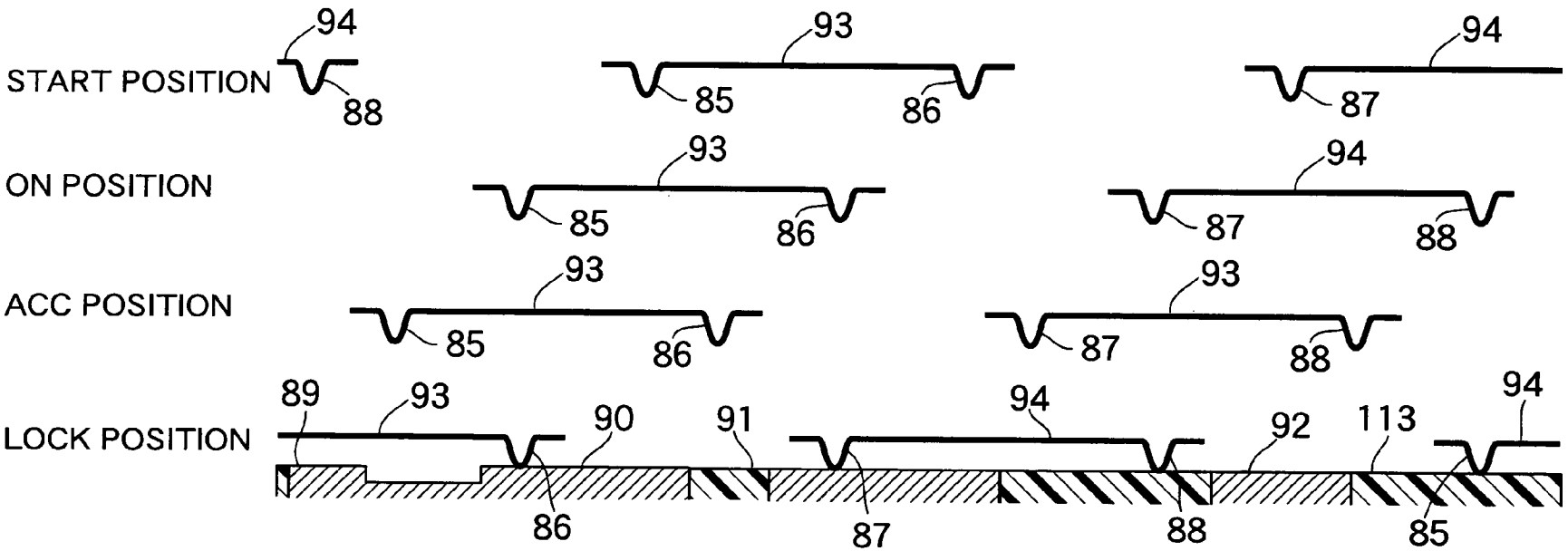
FIG. 18 is a diagram showing relative positions of a movable contact point and the fixed contact point of the second switch mechanism (first embodiment).

In the second switch mechanism 27, positioning of the movable contact points 85 to 88 relative to the power source fixed contact points 89 and 90, the IG1 fixed contact point 91, and the START fixed contact point 92 when the rotor 28 pivots to the LOCK position, the ACC position, the ON position, and the START position in sequence are as shown in FIG. 18.

In accordance with FIG. 18, in the LOCK position, the movable contact points 85 and 88 are not in contact with any of the fixed contact points whereas the movable contact point 86 is contact with the power source fixed point 90 and the movable contact point 87 is in contact with the IG1 fixed contact point 91; in the ACO position, the movable contact points 85, 86; 87, 88 are not in contact with any of the fixed contact points; in the ON position, the movable contact points 85 and 86 are in contact with the power source fixed contact point 90 and the IG1 fixed contact point 91 whereas the movable contact points 87 and 88 are not in contact with any of the fixed contact points; and in the START position, the movable contact points 85 and 86 are in contact with the power source fixed contact point 90 and the IG1 fixed contact point 91, and the movable contact points 87 and 88 are in contact with the START fixed contact point 92 and the power source fixed contact point 89. That is, in the second switch mechanism 27, in the ON position the IG1 fixed contact point 91 is connected to the power source fixed contact point 90, and in the START position the START fixed contact point 92 is connected to the power source fixed contact point 89, and the IG1 fixed contact point 91 is connected to the power source fixed contact point 90.

Among the terminal plates 76 to 78 insert-bonded to the first case half 30, parts of the terminal plates 77 and 78, which are used as the IG2 fixed contact point 71 and the ACC fixed contact point 72, project from one face of the first case half 30 as an IG2 external connection terminal 106 connected to the IG2 fixed contact point 71 and as an ACC external connection terminal 107 connected to the ACC fixed contact point 72. Furthermore, parts of the terminal plates 96 to 98 insert-bonded to the second case half 31 project from one face of the second case half 31 as a power source external connection terminal 108 connected to the power source fixed contact points 89 and 90, as an IG1 external connection terminal 109 connected to the IG1 fixed contact point 91, and as a START external connection terminal 110 connected to the START fixed contact point 92.

Moreover, part of the terminal plate 76 insert-bonded to the first case half 30 and part of the terminal plate 96 insert-bonded to the second case half 31 project outward from the first and second case halves 30 and 31 as joint parts 76*a* and 96*a*, and the two joint parts 76*a* and 96*a* are joined together.

Figure 19:
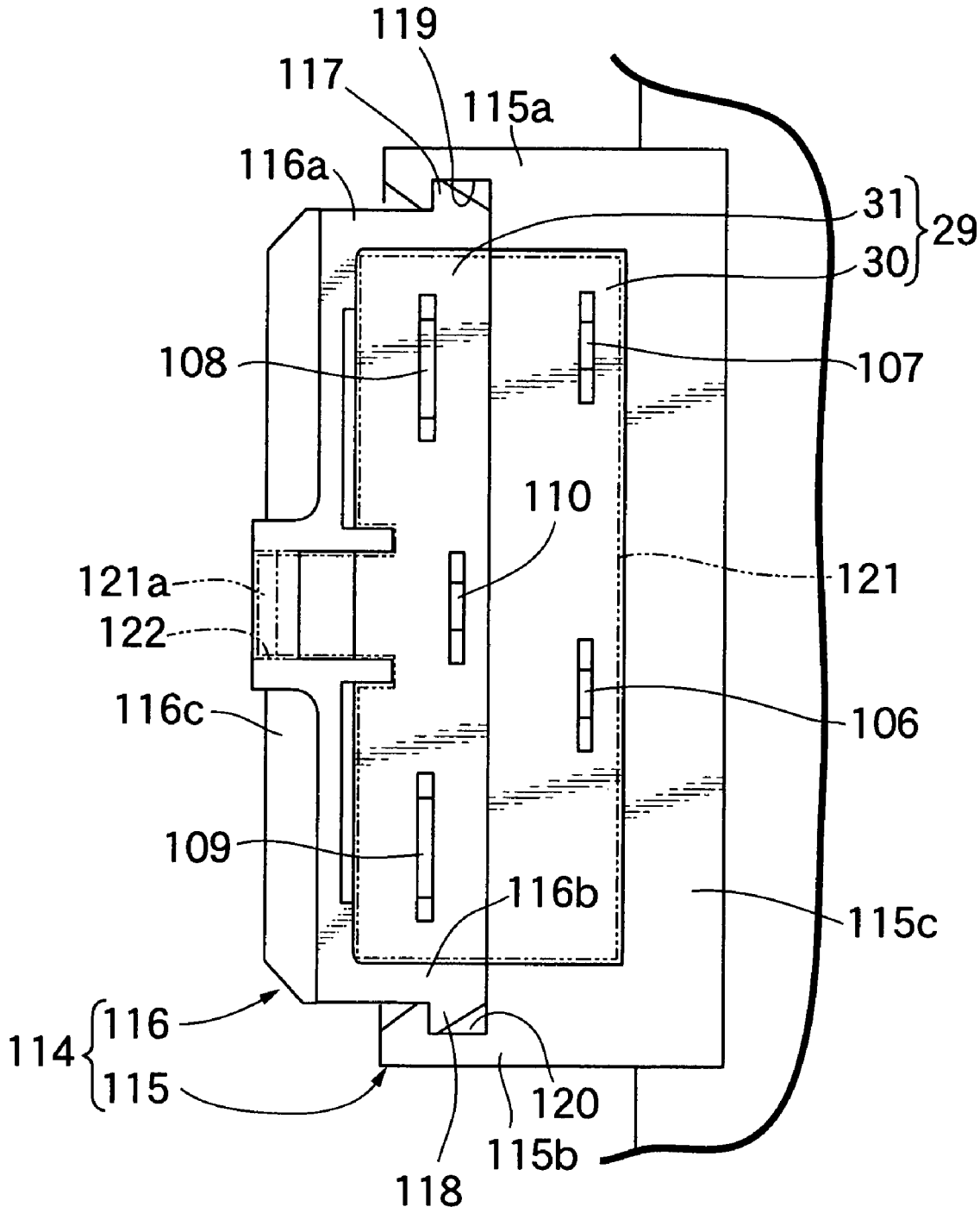
FIG. 19 is an enlarged view from arrow 19 in FIG. 1 (first embodiment).

Referring in addition to FIG. 19, the IG2 external connection terminal 106, the ACC external connection terminal 107, the power source external connection terminal 108, the IG1 external connection terminal 109, and the START external connection terminal 110, which project from one face of the switch case 29 formed by joining the first and second case halves 30 and 31, are surrounded by a coupler 114 having a rectangular cross section, and this coupler 114 is formed from a first coupler half 115 provided on the body 23 and a second coupler half 116 integrally formed with the cover member 48.

The first coupler half 115 has a pair of side wall portions 115*a* and 115*b* sandwiching the IG2 external connection terminal 106, the ACC external connection terminal 107, the power source external connection terminal 108, the IG1 external connection terminal 109, and the START external connection terminal 110 and a connecting wall portion 115*c* providing a connection between the side wall portions 115*a* and 115*b*, and is formed so as to surround the IG2 external connection terminal 106, the ACC external connection terminal 107, the power source external connection terminal 108, the IG1 external connection terminal 109, and the START external connection terminal 110 on three sides; the side wall portions 115*a* and 115*b* are integrally provided so as to be connected to the support walls 44 and 45, which are integrally provided with the rear part of the body 23 so as to sandwich the switch case 29 from opposite sides, the side wall portions 115*a* and 115*b* having the same cross section as that of the support walls 44 and 45 and extending downward; and the connecting wall portion 115*c* projects downward from the body 23 so that an inner face of the connecting wall portion 115*c* is connected flush with the support face 43 of the rear part of the body 23.

The second coupler half 116 is formed integrally with the cover member 48 so as to be detachably fitted into the two side wall portions 115*a* and 115*b* of the first coupler half 115, and integrally includes a pair of mating wall portions 116*a* and 116*b* that can be fitted into the pair of side wall portions 115*a* and 115*b* of the first coupler half 115, and a connecting wall portion 116*c* providing a connection between these mating wall portions 116*a* and 116*b*.

Moreover, projectingly provided on outer faces of the extremities of the two connecting wall portions 116*a* and 116*b* of the second coupler half 116 are latches 117 and 118 respectively that can resiliently engage with the two side wall portions 115*a* and 115*b* of the first coupler half 115 from the inside. That is, the inner faces of the two side wall portion 115*a* and 115*b* are provided with engagement grooves 119 and 120 respectively, and the latches 117 and 118 at the extremities of the two mating wall portions 116*a* and 116*b* resiliently engage with the engagement grooves 119 and 120 respectively.

When a partnering coupler 121 is fitted within the coupler 114 in a state in which the coupler 114 is formed from the first and second coupler halves 115 and 116, the outer face of the partnering coupler 121 abuts against the inner faces of the mating wall portions 116*a* and 116*b* of the second coupler half 116.

Furthermore, provided on the connecting wall portion 116*c* of the second coupler half 116 is an engagement hole 122 with which a latch 121*a* of the partnering coupler 121 resiliently engages.

Figure 20:
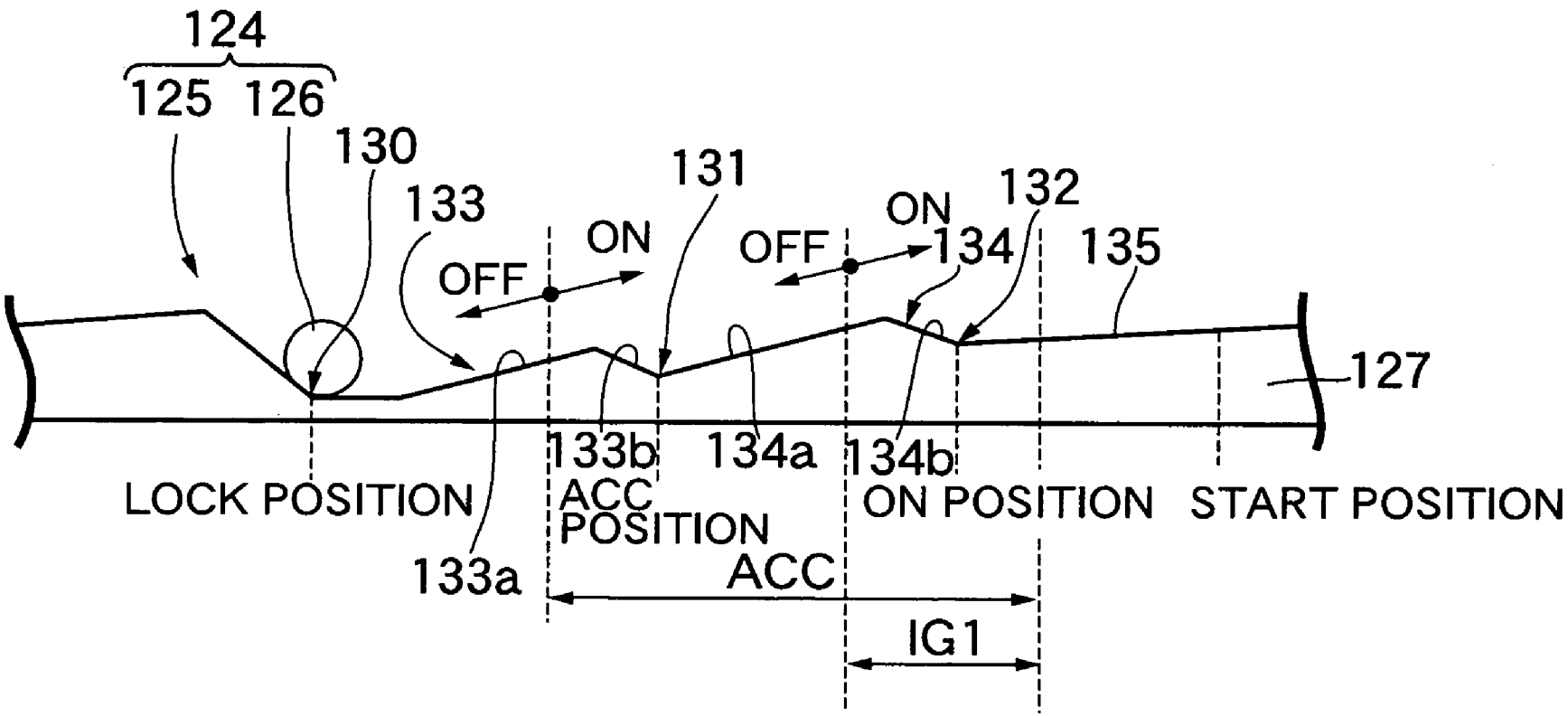
FIG. 20 is a developed view in the peripheral direction of a guide part on the first switch mechanism side (first embodiment).

In FIG. 20, pivoting of the pivoting shaft 25 and the rotor 28 in the first switch mechanism 26 is given a restraining feel by a click mechanism 124, and this click mechanism 124 is formed from a pair of guide parts 125 and rolling bodies 126, the guide parts 125 being formed in at least an arc shape with its center on the axis of the pivoting shaft 25 and being provided on the first case half 30 of the switch case 29, and the rolling bodies 126 being provided as an abutment engagement part on the pair of contact point plates 73 and 74 so that the rolling bodies 126 can abut against the guide parts 125.

Provided on the first case half 30 is a cylindrical part 127 that is coaxial with the pivoting shaft 25 and the support tube part 52 and surrounds portions provided with the power source fixed contact points 69 and 70, the IG2 fixed contact point 71, and the ACC fixed contact point 72 so that the extremity of the cylindrical part 127 faces outer peripheral parts of the contact point plates 73 and 74 floatingly supported on the rotor 28, and provided at the extremity of the cylindrical part 127 are the pair of guide parts 125 formed in at least an arc shape so as to be symmetrical with respect to a point on the axis of the support tube part 52.

Provided on the contact point plates 73 and 74 are holding parts 128 protruding in a semicircular shape toward the rotor 28 side in middle parts between the movable contact points 65 and 66; 67, 68, the rolling bodies 126 being rotatably held by these holding parts 128.

Provided, spaced from each other, on the guide part 125 are a LOCK positioning part 130 positioning and holding the rolling body 126 when the rotor 28 is in the LOCK position, an ACC positioning part 131 positioning and holding the rolling body 126 when the rotor 28 is in the ACC position, and an ON positioning part 132 positioning and holding the rolling body 126 when the rotor 28 is in the ON position.

Two cam lobes 133 and 134 are provided between the LOCK positioning part 130 and the ON positioning part 132 on the guide part 125; the cam lobe 133 between the LOCK positioning part 130 and the ACC positioning part 131 is formed in a peak shape in which an ascent part 133*a* and a descent part 133*b* are connected in sequence, the ascent part 133*a* making the rolling body 126 ascend along a direction in which the rotor 28 moves so as to make the movable contact point 68 contact the power source fixed contact point 69, and the descent part 133*b* making the rolling body 126 descend. The cam lobe 134 between the ACC positioning part 131 and the ON positioning part 132 is formed in a peak shape in which an ascent part 134*a* and a descent part 134*b* are connected in sequence, the ascent part 134*a* making the rolling body 126 ascend along a direction in which the rotor 28 moves so as to make the movable contact points 65 and 66 contact the power source fixed contact point 70 and the IG2 fixed contact point 71, and the descent part 134*b* making the rolling body 126 descend. Since it is unnecessary to carry out positioning and holding in the START position, no positioning part is set, but a gentle ascent part 135 is formed on the guide part 125 so that the rolling body 126 gently ascends when the rotor 28 is pivoted from the ON positioning part 132 to the START position.

The first switch mechanism 26 connects the ACC fixed contact point 72 to the power source fixed contact point 69 when the rotor 28 is in the ACC position, and connects the ACC fixed contact point 72 to the power source fixed contact point 69 and the IG2 fixed contact point 71 to the power source fixed contact point 70 in the ON position; a connection angle at which the ACC fixed contact point 72 is connected to the power source fixed contact point 69 is set so as to extend from a middle part of the ascent part 133*a* of the cam lobe 133, through the cam lobe 134, to partway along the ascent part 135, and a connection angle at which the IG2 fixed contact point 71 is connected to the power source fixed contact point 70 is set so as to extend from a middle part of the ascent part 134*a* of the cam lobe 134 to partway along the ascent part 135. That is, the cam lobe 133 is formed so that the movable contact points 67 and 68 start contacting the ACC fixed contact point 72 and the power source fixed contact point 69 during the course of the rolling body 126 ascending the ascent part 133*a*, and the movable contact points 67 and 68 start separating from the ACC fixed contact point 72 and the power source fixed contact point 69 during the course of descending the ascent part 133*a*, and the cam lobe 134 is formed so that the movable contact points 65 and 66 start contacting the power source fixed contact point 70 and the IG2 fixed contact point 71 during the course of the rolling body 126 ascending the ascent part 134*a*, and the movable contact points 65 and 66 start separating from the power source fixed contact point 70 and the IG2 fixed contact point 71 during the course of the rolling body 126 descending the ascent part 134*a*.

Figure 21:
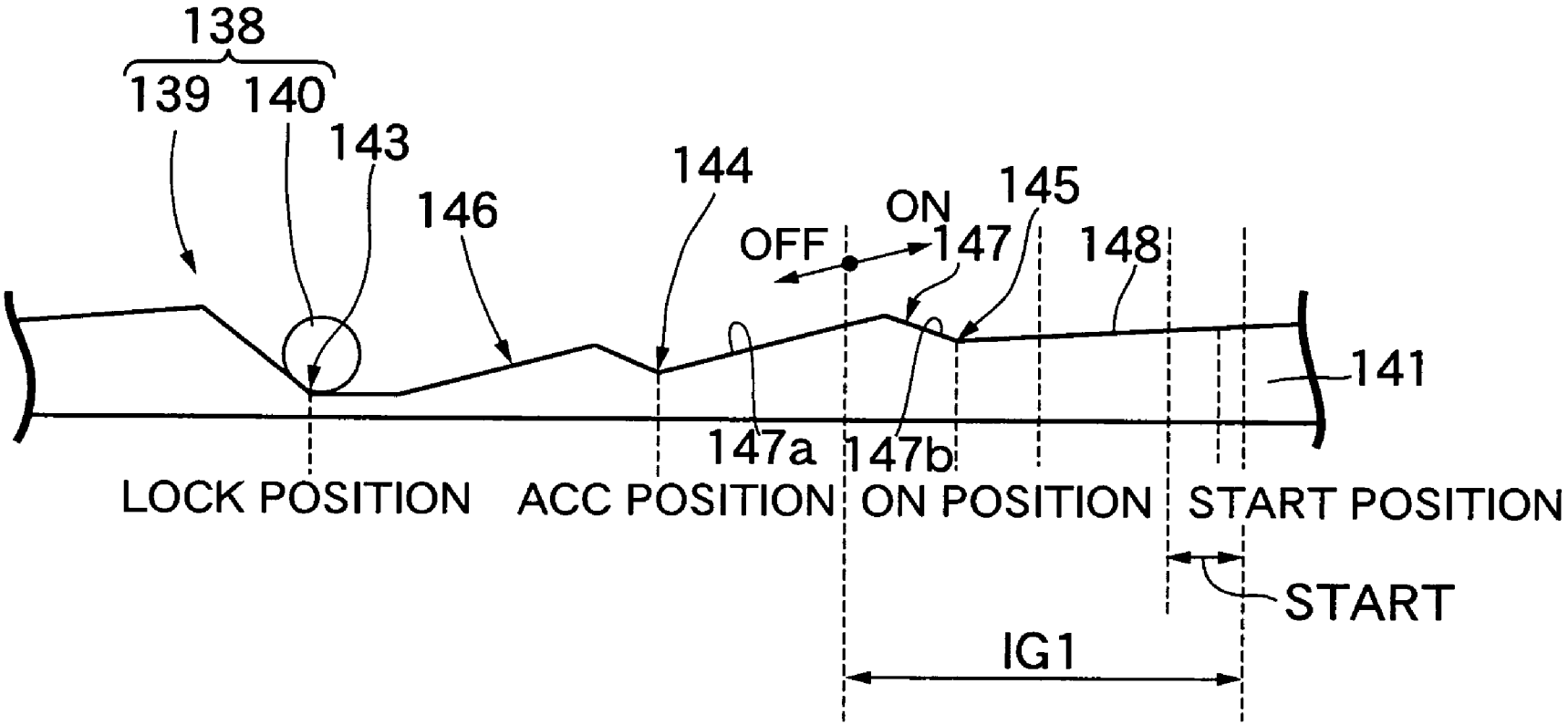
FIG. 21 is a developed view in the peripheral direction of a guide part on the second switch mechanism side (first embodiment).

In FIG. 21, pivoting of the pivoting shaft 25 and the rotor 28 in the second switch mechanism 27 is given a restraining feel by a click mechanism 138, and this click mechanism 138 is formed from a pair of guide parts 139 and rolling bodies 140, the guide parts 139 being formed in at least an arc shape with its center on the axis of the pivoting shaft 25 and being provided on the second case half 31 of the switch case 29, and the rolling bodies 140 being provided as an abutment engagement part on the pair of contact point plates 93 and 94 so that the rolling bodies 140 can abut against the guide parts 139.

Provided on the second case half 31 is a cylindrical part 141 that is coaxial with the pivoting shaft 25 and the support tube part 53 and surrounds portions provided with the power source fixed contact points 89 and 90, the IG1 fixed contact point 91, and the START fixed contact point 92 so that the extremity of the cylindrical part 141 faces outer peripheral parts of the contact point plates 93 and 94 floatingly supported on the rotor 28, and provided at the extremity of the cylindrical part 141 are the pair of guide parts 139 formed so as to be symmetrical with respect to a point on the axis of the support tube part 53.

Provided on the contact point plates 93 and 94 are holding parts 142 protruding in a semicircular shape toward the rotor 28 side in middle parts between the movable contact points 85, 86; 87, 88, the rolling bodies 140 being rotatably held by these holding parts 142.

Provided, spaced from each other, on the guide part 139 are a LOCK positioning part 143 positioning and holding the rolling body 140 when the rotor 28 is in the LOCK position, an ACC positioning part 144 positioning and holding the rolling body 140 when the rotor 28 is in the ACC position, and an ON positioning part 145 positioning and holding the rolling body 140 when the rotor 28 is in the ON position.

Two cam lobes 146 and 147 are provided between the LOCK positioning part 143 and the ON positioning part 144 on the guide part 139, and the cam lobe 147 between the ACC positioning part 144 and the ON positioning part 145 is formed in a peak shape in which an ascent part 147*a* and a descent part 147*b* are connected in sequence, the ascent part 147*a* making the rolling body 140 ascend along a direction in which the rotor 28 moves so as to make the movable contact points 85 and 86 contact the power source fixed contact point 90 and the IG1 fixed contact point 91, and the descent part 147*b* making the rolling body 140 descend. Furthermore, a gentle ascent part 148 is formed on the guide part 125 so that the rolling body 140 gently ascends when the rotor 28 is pivoted from the ON positioning part 144 to the START position. The positioning parts 143 to 145, the cam lobes 146 and 147, and the ascent part 148 on the guide part 139 are formed with the same phase as that of the positioning parts 130 to 132, the cam lobes 133 and 134, and the ascent part 135 on the guide part 125 of the first switch mechanism 26.

The second switch mechanism 27 connects the IG1 fixed contact point 91 to the power source fixed contact point 90 when the rotor 28 is in the ON position, and connects the IG1 fixed contact point 91 to the power source fixed contact point 90 and the START fixed contact point 92 to the power source fixed contact point 89 when the rotor 28 is in the START position; a connection angle at which the IG1 fixed contact point 91 is connected to the power source fixed contact point 90 is set so as to extend from a middle part of the ascent part 147*a* of the cam lobe 147 to partway along the ascent part 148, and a connection angle at which the START fixed contact point 92 is connected to the power source fixed contact point 89 is set in a predetermined range of a middle part of the ascent part 148. That is, the cam lobe 147 is formed so that the movable contact points 85 and 86 start contacting the power source fixed contact point 90 and the IG1 fixed contact point 91 during the course of the rolling body 140 ascending the ascent part 147*a*, and the movable contact points 85 and 86 start separating from the power source fixed contact point 90 and the IG1 fixed contact point 91 during the course of descending the ascent part 147*a*.

Figure 7:
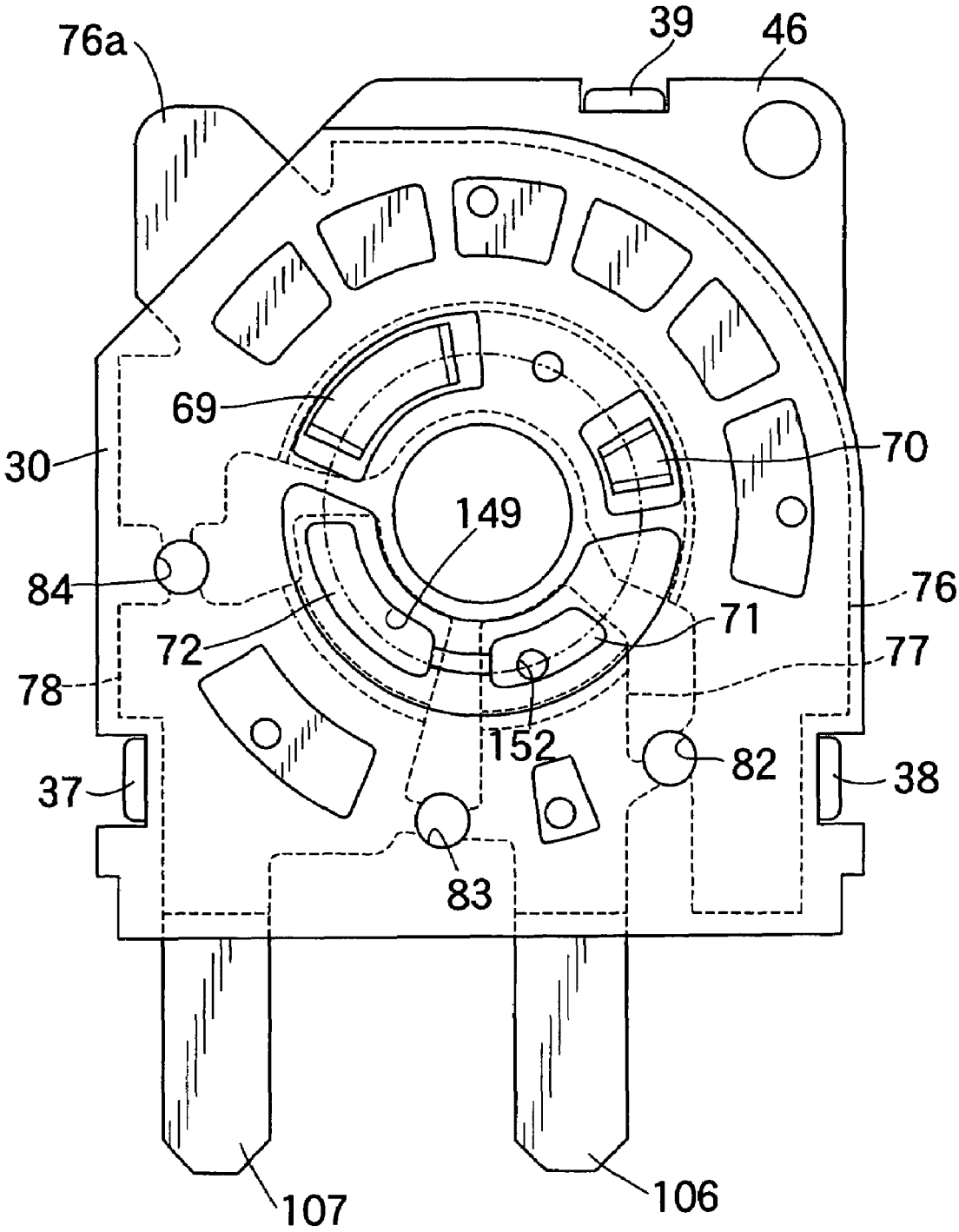
FIG. 7 is a view of the first case half from the side opposite to that of FIG. 6 (first embodiment).
Figure 8:
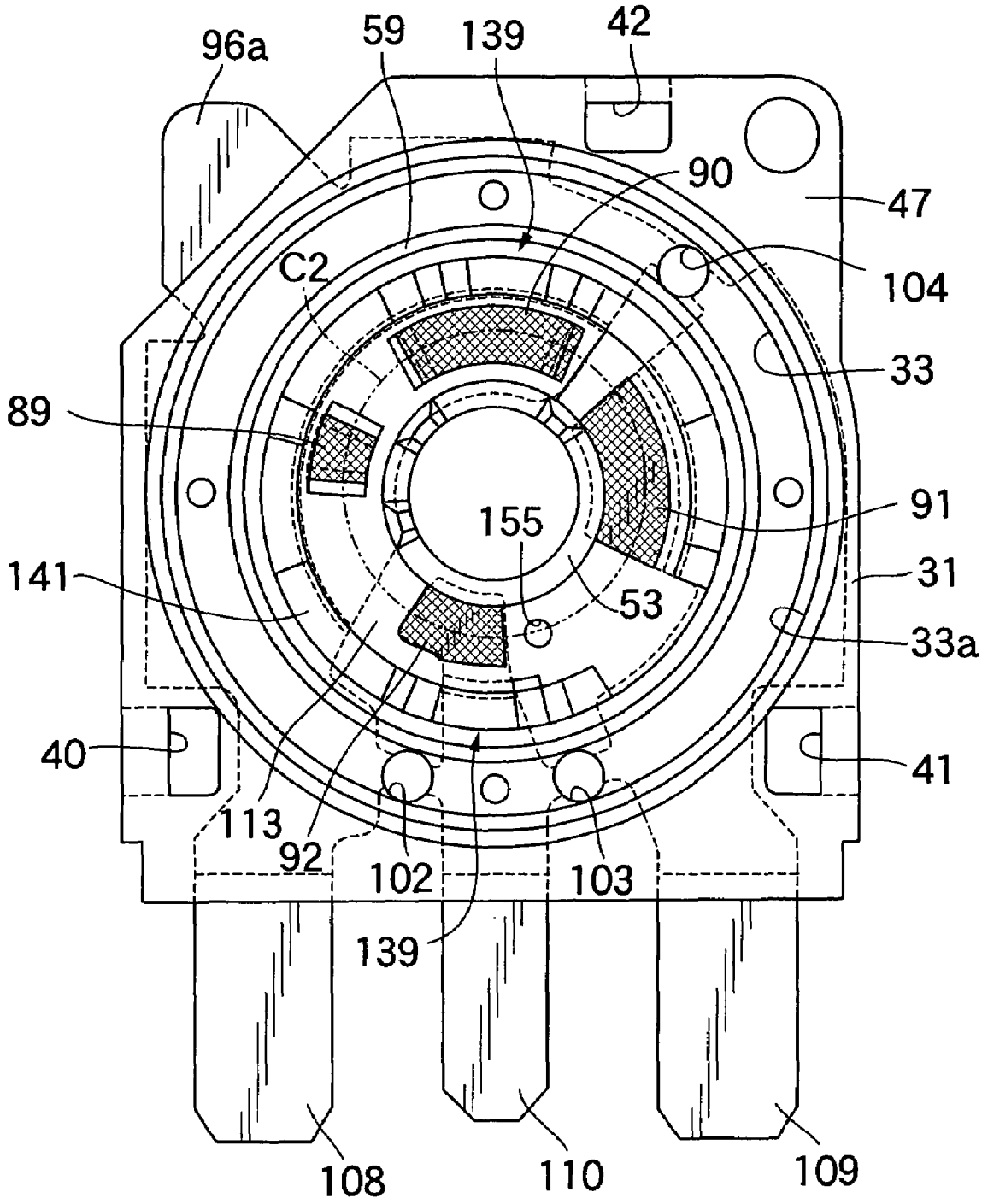
FIG. 8 is a view of a second case half from the direction of arrowed line 8-8 in FIG. 3 (first embodiment).

In the first switch mechanism 26, a recess 149 is provided in a rear part of the sliding surface 112 provided on the first case half 30 as clearly shown in FIG. 7 so that rear faces of the IG2 fixed contact point 71 and the ACC fixed contact point 72 face the recess 149, and this recess 149 is closed by a cover member 150 detachably fitted to the first case half 30 from the body 23 side. A grease reservoir 151 is formed between the cover member 150 and the first case half 30, the grease reservoir 151 being disposed on the rear part of the sliding surface 112, and the sliding surface 112 and the grease reservoir 151 communicate via a connecting hole 152 positioned on the locus C1 of the movable contact points 65 to 68 on a sliding contact area of the sliding surface 112, this connecting hole 152 being provided in, for example, the IG2 fixed contact point 71.

Figure 9:
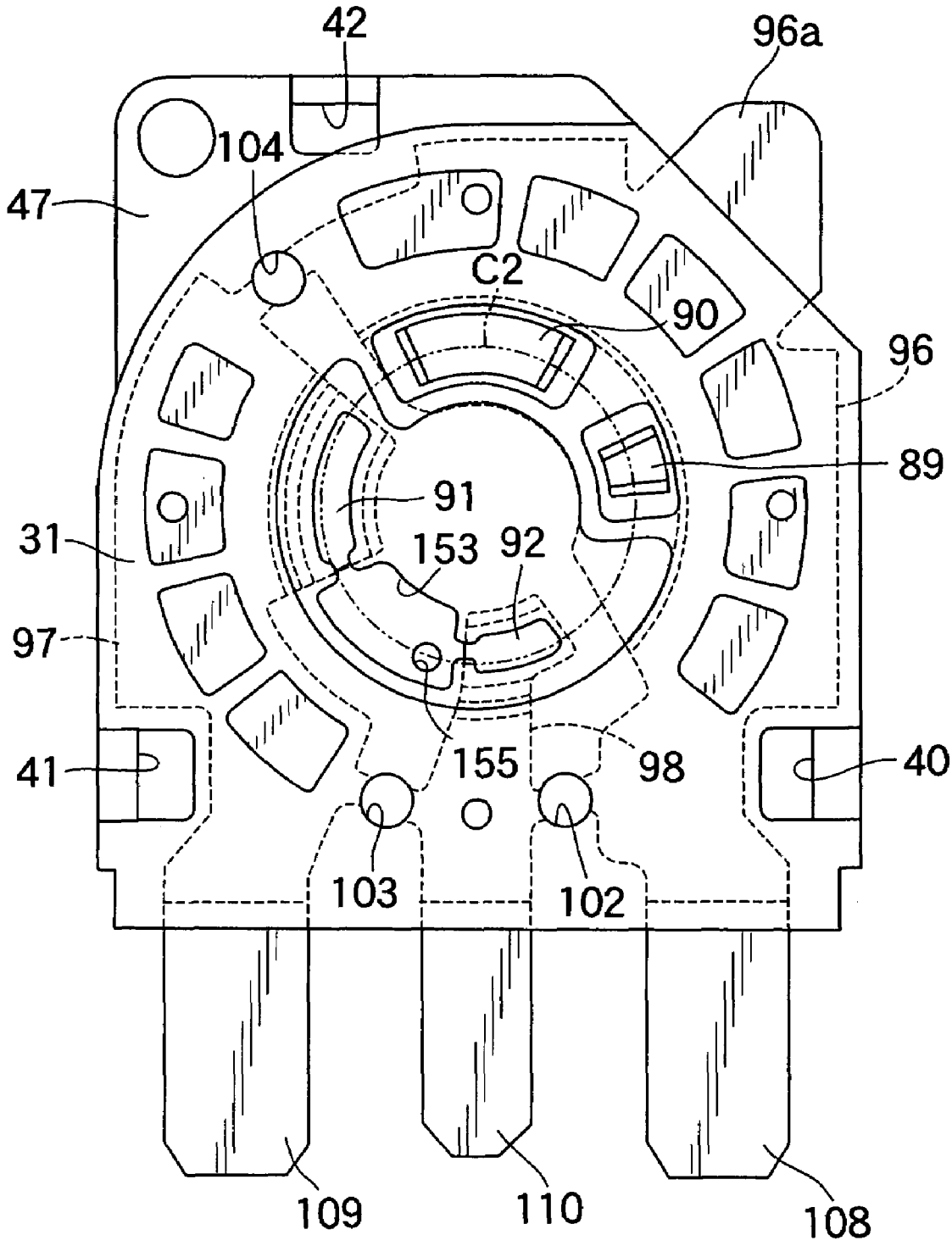
FIG. 9 is a view of the second case half from the side opposite to that of FIG. 8 (first embodiment).

In the second switch mechanism 27, a recess 153 is provided on a rear part of the sliding surface 113 provided on the second case half 31 as clearly shown in FIG. 9 so that rear faces of the IG1 fixed contact point 91 and the START fixed contact point 92 face the recess 153, and this recess 153 is closed by a cover member 48 covering the second first case half 31 from a side opposite to the body 23. A grease reservoir 154 is formed between the cover member 48 and the second case half 31, the grease reservoir 154 being disposed on the rear part of the sliding surface 113, and the sliding surface 113 and the grease reservoir 154 communicate via a connecting hole 155 positioned on the locus C2 of the movable contact points 85 to 88 on a sliding contact area of the sliding surface 113, this connecting hole 155 being provided in, for example, the second case half 31.

The operation of this first embodiment is now explained. The first switch mechanism 26 is formed from the movable contact points 65 to 68, which are disposed on one face of the single rotor 28 coaxially joined to the pivoting shaft 25 pivotably supported on the body 23 so that the rotor 28 cannot rotate relative to the pivoting shaft 25, and the fixed contact points 69 to 72, which are provided on the inner face, corresponding to said one face of the rotor 28, of the first case half 30 which, among the first and second case halves 30 and 31 connected to each other with the rotor 28 sandwiched therebetween in order to form the switch case 29 housing the rotor 28, is disposed on the body 23 side, the second switch mechanism 27 is formed from the movable contact points 85 to 88, which are disposed on the other face of the rotor 28, and the fixed contact points 89 to 92, which are provided on the inner face of the second case half 31 opposing said other face of the rotor 28, and it is therefore possible to reduce the dimensions of the ignition switch 24 in the radial and axial directions as well as to reduce the number of components.

Furthermore, since the fixed contact points 69 to 72; 89 to 92 are formed on the plurality of conductive metal terminal plates 76 to 78; 96 to 98 respectively, which are insert-bonded to the synthetic resin first and second case halves 30 and 31, the fixed contact points 69 to 72; 89 to 92 are firmly fixed to the first and second case halves 30 and 31. Moreover, since, among the terminal plates 76 to 78; 96 to 98, parts of at least some of the terminal plates 77, 78, 96 to 98 project from the first and second case halves 30 and 31 so as to form the external connection terminals 106 to 110, the fixed contact points 69 to 72; 89 to 92 are easily connected to the exterior.

Furthermore, since, among the fixed contact points 69 to 72; 89 to 92 of the first and second switch mechanisms 26 and 27, the terminal plates 76 and 96, which form the power source fixed contact points 69, 70; 89, 90 connected to the power source, are joined to each other outside the first and second case halves 30 and 31, the power source external connection terminal 108 can be shared by the first and second case halves 30 and 31.

The synthetic resin cover member 48 covering at least part of the switch case 29 is mounted on the body 23, and the first coupler half 115, which has the pair of side wall portions 115*a* and 115*b* that sandwich the plurality of external connection terminals 106 to 110 projecting from one face of the switch case 29 and has the connecting wall portion 115*c* connecting the side wall portions 115*a* and 115*b*, and which surrounds the external connection terminals 106 to 110 on three sides, is formed integrally with the body 23. The second coupler half 116, which forms the coupler 114 in cooperation with the first coupler half 115, the coupler 114 having a tubular shape with a rectangular cross section surrounding the external connection terminals 106 to 110, is formed integrally with the cover member 48 so that the second coupler half 116 is detachably fitted into the two side wall portions 115*a* and 115*b* of the first coupler half 115.

That is, since half of the coupler 114, which has the rectangular cross section, is formed from the first coupler half 115 formed integrally with the metal body 23, and the remaining half of the coupler 114 is formed from the second coupler half 116 formed integrally with the synthetic resin cover member 48 covering at least part of the switch case 29, it is possible to form the coupler 114 while reducing the dimensions of the switch case 29 and, moreover, since the first coupler half 115 is made of metal, it is possible to increase the strength of the coupler 114.

Furthermore, since the pair of mating wall portions 116*a* and 116*b*, which can be fitted into the pair of side wall portions 115*a* and 115*b* of the first coupler half 115, are provided on the second coupler half 116 so that the inner faces of the mating wall portions 116*a* and 116*b* abut against the outer face of the partnering coupler 121 when the partnering coupler 121 is fitted into the coupler 114, and the latches 117 and 118, which can resiliently engage with the two side wall portions 115*a* and 115*b* from the inside, are projectingly provided on the outer faces of the mating wall portions 116*a* and 116*b*, it becomes easy to assemble the second coupler half 116 to the first coupler half 115 and, moreover, since the outer face of the partnering coupler 121 abuts against the inner faces of the pair of mating wall portions 116*a* and 116*b* of the second coupler half 116 when the partnering coupler 121 is fitted into the coupler 114, a state in which the two mating wall portions 166*a* and 116*b* are fitted into the two side wall portions 115*a* and 115*b* is firmly maintained.

The first and second case halves 30 and 31 forming the switch case 29 are provided with the sliding surfaces 112 and 113 for the movable contact points 65 to 68; 85 to 88 to slide on, the IG2 fixed contact point 71 and the ACC fixed contact point 72 are provided so as to be flush with the sliding surface 112, the IG1 fixed contact point 91 and the START fixed contact point 92 are provided so as to be flush with the sliding surface 113, and the grease reservoirs 151 and 154 are formed on the rear parts of the sliding surfaces 112 and 113. Moreover, the sliding surface 112 and the grease reservoir 151 are connected to each other via the connecting hole 152 provided in the IG2 fixed contact point 71 so that the connecting hole 152 is positioned on the locus C1 of the movable contact points 65 to 68 on the sliding contact area of the sliding surface 112, and the sliding surface 113 and the grease reservoir 154 are connected to each other via the connecting hole 155 provided in the second case half 31 so that the connecting hole 155 is positioned on the locus C2 of the movable contact points 85 to 88 on the sliding contact area of the sliding surface 113.

Therefore, each time the movable contact points 65 to 68; 85 to 88 slide on the sliding surfaces 112 and 113, an oil component of grease retained in the grease reservoirs 151 and 154 is supplied to the areas of sliding contact between the movable contact points 65 to 68; 85 to 88 and the sliding surfaces 112 and 113 via the connecting hole 152 and the oil component is spread out over the sliding locus of the movable contact points 65 to 68; 85 to 88. In this process, the thickness of an oil film over the sliding locus is substantially uniform by virtue of surface tension, and the amount of grease supplied is automatically adjusted in accordance with the amount of grease consumed by self-heating due to arc dissociation or Joule heating. Therefore, regardless of the extent of the electrical load and the number of times of repetition, an appropriate amount of grease is always maintained over the sliding locus, and it becomes possible to maintain insulation and durability for a long period of time by maintaining an appropriate amount of grease between the movable contact points 65 to 68; 85 to 88 and the fixed contact points 69 to 72; 89 to 92 while making it unnecessary to increase the distance between the contact points, thereby reducing the dimensions of the ignition switch 24.

In the first and second switch mechanisms 26 and 27, the click mechanisms 124 and 138 for imparting a restraining feel to pivoting of the pivoting shaft 25 and the rotor 28 are formed from the guide parts 125 and 139 formed in at least the arc shape with its center on the axis of the pivoting shaft 25 and provided with the positioning parts 130, 131, 132; 143, 144, 145 at the plurality of positions, and the rolling bodies 126 and 140 as the abutment engagement parts provided on the contact point plates 73, 74; 93, 94 floatingly supported on the rotor 28, the rolling bodies 126 and 140 abutting against the guide parts 125 and 139 so that the rolling bodies 126 and 140 detachably engage with the positioning parts 130, 131, 132; 143, 144, 145.

It is therefore possible to accurately position the contact point plates 73, 74; 93, 94, that is, the movable contact points 65 to 68; 85 to 88 at a predetermined pivot position, it is therefore unnecessary to make up for backlash of the contact point plates 73, 74; 93, 94 relative to the rotor 28 by the size of the contact point plates 73, 74; 93, 94, and since there is no need to make the contact point plates 73, 74; 93, 94 large, it is possible to avoid any increase in the dimensions of the ignition switch 24.

Moreover, since the rolling bodies 126 and 140 are assembled pivotably to the contact point plates 73, 74; 93, 94 as separate bodies from the contact point plates 73, 74; 93, 94, it is possible to reduce frictional loss when moving while abutting against the guide parts 125 and 139.

Furthermore, in the guide part 125 of the first switch mechanism 26, there are provided the two cam lobes 133 and 134 between the LOCK positioning part 130 and the ON positioning part 132, the cam lobe 133 is formed so that the movable contact point 68 starts contacting the power source fixed contact point 69 during the course of the rolling body 126 ascending the ascent part 133*a*, and the movable contact point 68 starts separating from the power source fixed contact point 69 during the course of descending the ascent part 133*a*, and the cam lobe 134 is formed so that the movable contact points 65 and 66 start contacting the power source fixed contact point 70 and the IG2 fixed contact point 71 during the course of the rolling body 126 ascending the ascent part 134*a*, and the movable contact points 65 and 66 start separating from the power source fixed contact point 70 and the IG2 fixed contact point 71 during the course of the rolling body 126 descending the ascent part 134*a*.

That is, when a constant operating force acts on the rotor 28 so as to move the rotor 28 toward the side on which the movable contact point 68 comes into contact with the fixed contact point 69 and the movable contact points 65 and 66 come into contact with the power source fixed contact points 70 and the IG2 fixed contact point 71, since when the rolling body 126 ascends the ascent parts 133*a* and 134*a* of the cam lobes 133 and 134 the spring force that urges the rolling body 126 so as to make it abut against the cam 133 gradually increases, the speed when the movable contact points 68, 65, and 66 start contacting the fixed contact points 69, 70, and 71 becomes relatively slow; and when the rotor 28 is moved to the side on which the movable contact point 68 separates from the power source fixed contact point 69 and the movable contact points 65 and 66 separate from the fixed contact point 70 and the IG2 fixed contact point 71, since when the rolling body 126 descends the ascent parts 133*a* and 134*a* of the cam lobes 133 and 134 the spring force that urges the rolling body 126 so as to make it abut against the cam lobes 133 and 134 gradually decreases, the speed when the movable contact points 68, 65, and 66 start separating from the fixed contact points 69, 70, and 71 becomes relatively fast. That is, it is possible to decrease the speed when the movable contact points 68, 65, and 66 start contacting the fixed contact points 69, 70, and 71 and increase the speed of separation of the movable contact points 68, 65, and 66 from the fixed contact points 69, 70, and 71, and it is therefore possible to prevent the occurrence of any adverse influence on contact point performance accompanying opening and closing of the movable contact points 68, 65, and 66 and the fixed contact points 69, 70 and 71.

Furthermore, in the guide part 139 of the second switch mechanism 27, there are provided the two cam lobes 146 and 147 between the LOCK positioning part 143 and the ON positioning part 144, and the cam lobe 147 is formed so that the movable contact points 85 and 86 start contacting the power source fixed contact point 90 and the IG1 fixed contact point 91 during the course of the rolling body 140 ascending the ascent part 147*a* and the movable contact points 85 and 86 start separating from the power source fixed contact point 90 and the IG1 fixed contact point 91 during the course of descending the ascent part 147*a*.

That is, when a constant operating force acts on the rotor 28 so as to move the rotor 28 toward the side on which the movable contact points 85 and 86 come into contact with the fixed contact point 90 and the IG1 fixed contact point 91, since when the rolling body 140 ascends the ascent part 147*a* of the cam lobe 147 the spring force that urges the rolling body 140 so as to make it abut against the cam 147 gradually increases, the speed when the movable contact points 85 and 86 start contacting the fixed contact points 90 and 91 becomes relatively slow; and when the rotor 28 is moved to the side on which the movable contact points 85 and 86 separate from the power source fixed contact point 90 and the IG1 fixed contact point 91, since when the rolling body 140 descends the ascent part 147*a* of the cam lobe 147 the spring force that urges the rolling body 140 so as to make it abut against the cam lobe 147 gradually decreases, the speed when the movable contact points 85 and 86 start separating from the fixed contact point 90 and 91 becomes relatively fast. That is, it is possible to decrease the speed when the movable contact points 85 and 86 start contacting the fixed contact points 90 and 91 and increase the speed of separation of the movable contact points 85 and 86 from the fixed contact points 90 and 91, and it is therefore possible to prevent the occurrence of any adverse influence on contact point performance accompanying opening and closing of the movable contact points 85 and 86 and the fixed contact points 90 and 91.

Embodiment 2

Figure 22:
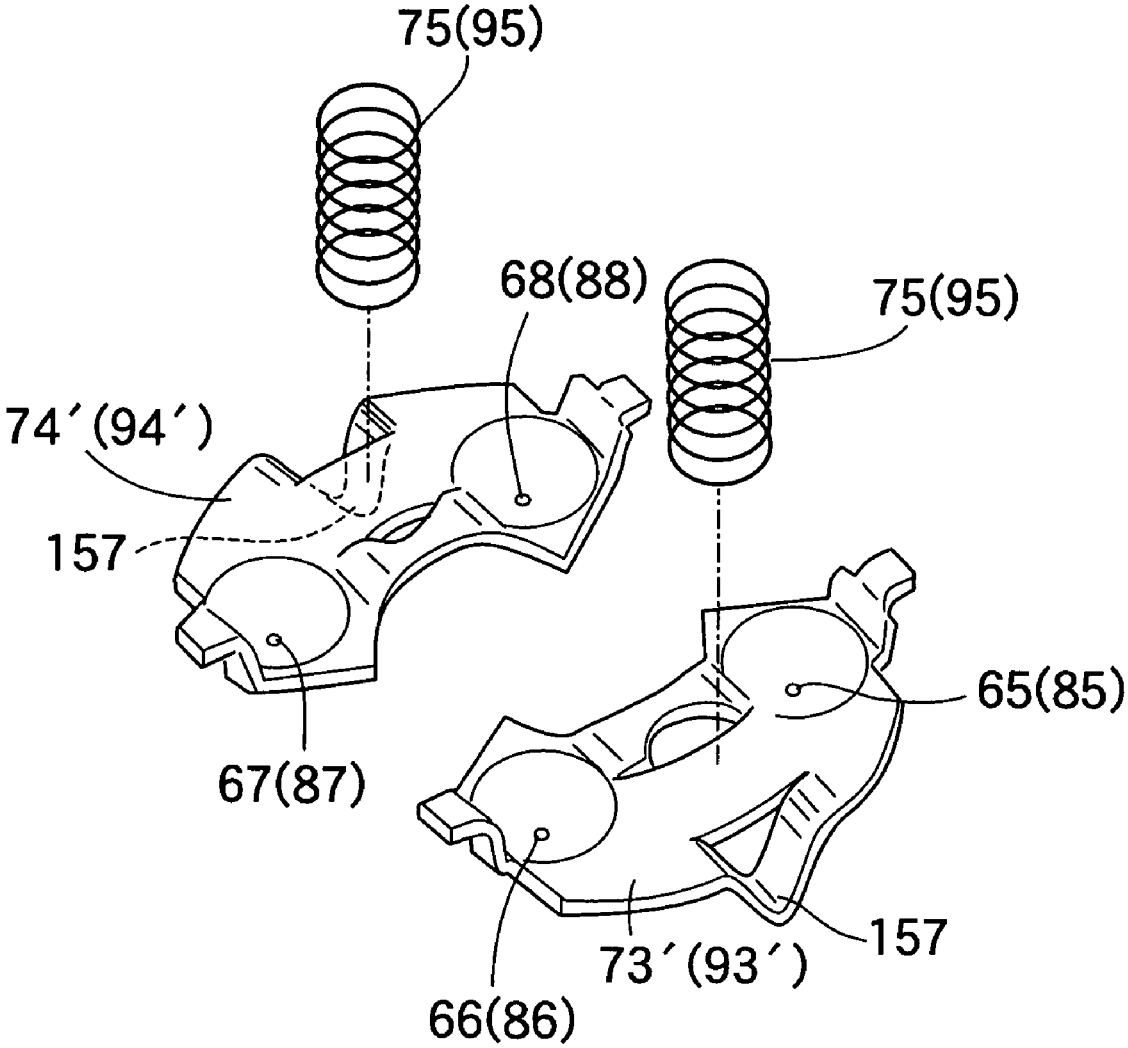
FIG. 22 is a perspective view of an essential part of a second embodiment (second embodiment).

As a second embodiment of the present invention, as shown in FIG. 22, abutment engagement parts 157 forming part of the click mechanism may be provided integrally with contact point plates 73', 74'; 93', 94' on which the movable contact points 65 to 68, 85 to 88 are provided.

In accordance with this second embodiment, since the abutment engagement parts 157 are integrated with the contact point plates 73', 74'; 93', 94', the number of components can be reduced.

Embodiment 3

Figure 23:
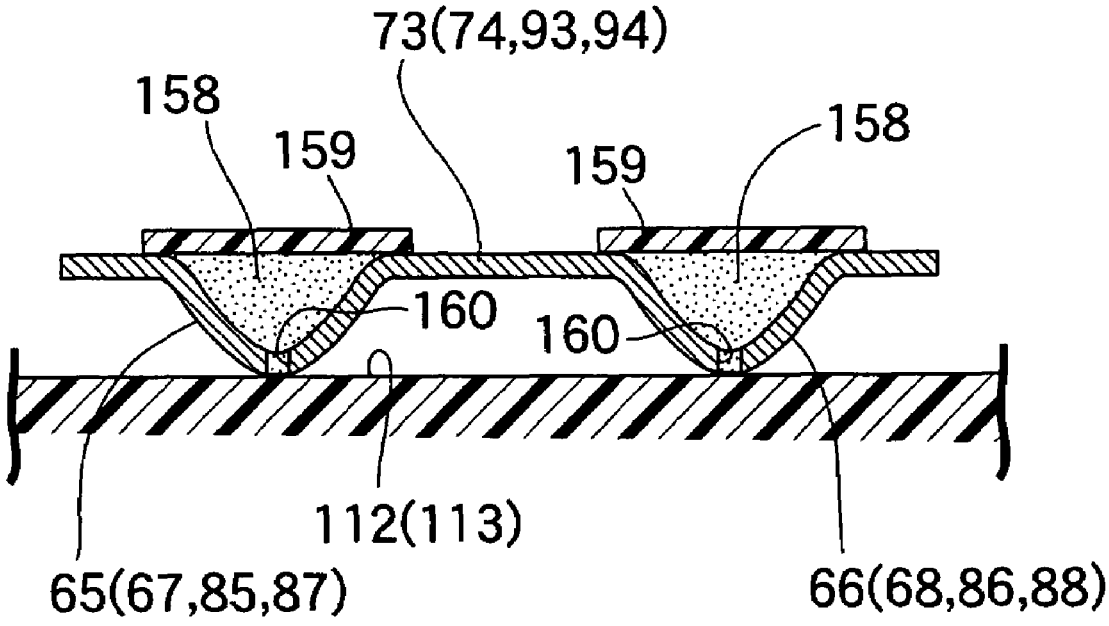
FIG. 23 is a sectional view of an essential part of a third embodiment (third embodiment).

As a third embodiment of the present invention, as shown in FIG. 23, by closing, with cover members 159, rear parts of the movable contact points 65 to 68, 85 to 88 formed in a conical shape so as to be in sliding contact with the sliding surfaces 112 and 113, grease reservoirs 158 may be formed in the rear parts of the movable contact points 65 to 68, 85 to 88, and connecting holes 160 having an outer end opening at the extremity of each of the movable contact points 65 to 68, 85 to 88, that is, areas in sliding contact with the sliding surface and having an inner end communicating with the grease reservoirs 158, may be provided.

Although embodiments of the present invention are explained above, the present invention is not limited to the above-mentioned embodiments, and various types of modifications may be carried out as long as they do not depart from the present invention described in Claims.

The invention claimed is:

1. A rotary switch device comprising:

first and second switch mechanisms each formed from a movable contact point that pivots in response to pivoting of a pivoting shaft and a fixed contact point that comes into contact with the movable contact point at a set pivot position of the pivoting shaft, wherein the first switch mechanism is formed from the movable contact point disposed opposite one face of a single rotor coaxially connected to the pivoting shaft so that the single rotor cannot rotate relative to the pivoting shaft, the first switch mechanism being floatingly supported on the rotor by a first spring disposed directly between and contacting the first switch mechanism and the rotor, and the fixed contact point provided on an inner face, corresponding to said one face of the rotor, of one of a pair of case halves joined to each other while sandwiching the rotor from opposite sides so as to form a switch case housing the rotor, and wherein the second switch mechanism is formed from the movable contact point disposed opposite the other face of the rotor, the second switch mechanism being floatingly supported on the rotor by a second spring disposed directly between and contacting the second switch mechanism and the rotor, and the fixed contact point provided on an inner face of the other case half facing the other face of the rotor.

2. The rotary switch device according to claim 1, wherein the fixed contact points are formed on a plurality of conductive metal terminal plates insert-bonded to the two case halve, which are made of a synthetic resin, and parts of at least some of the terminal plates project from the case halves so as to form external connection terminals.

3. The rotary switch device according to claim 2 wherein, among the fixed contact points of the first and second switch mechanisms, the terminal plates forming the fixed contact points connected to a power source are joined to each other outside the two case halves.

4. The rotary switch device according to claim 2, wherein a synthetic resin cover member covering at least part of the switch case, which is mounted on a metal body pivotably supporting the pivoting shaft, is mounted on the body, a first coupler half is formed integrally with the body, the first coupler half having a pair of side wall portions sandwiching a plurality of the external connection terminals therebetween and a connecting wall portion connecting the side wall portions and the first coupler half surrounding the external connection terminals on three sides, and a second coupler half is formed integrally with the cover member so as to be detachably fitted into the side wall portions of the first coupler half, the second coupler half forming in cooperation with the first coupler half a coupler that is a cylinder with a rectangular cross section and surrounds the plurality of external connection terminals.

5. The rotary switch device according to claim 4, wherein a pair of mating wall portions are provided on the second coupler half so that an inner face of the mating wall portions abuts against an outer face of a partnering coupler when the partnering coupler is fitted into the coupler, the mating wall portions being capable of being fitted into the pair of side wall portions of the first coupler half (145), and latches are projectingly provided on outer faces of the mating wall portions, the latches being capable of resiliently engaging with the two side wall portions from the inside.

6. The rotary switch device according to claim 1, wherein conductive metal contact point plates having the movable contact points are spring-biased toward a side in which the movable contact points come into contact with the fixed contact points, and a click mechanism imparting a restraining feel to pivoting of the pivoting shaft and the rotor is formed from a guide part and an abutment engagement part, the guide part being formed in at least an arc shape with its center on the axis of the pivoting shaft and having positioning parts provided at a plurality of positions, and the abutment engagement part being provided on the contact point plate so as to abut against the guide part, the abutment engagement part being capable of detachably engaging with the positioning parts.

7. The rotary switch device according to claim 6, wherein the abutment engagement part is a rolling body assembled to the contact point plate as a separate body from the contact point plate.

8. The rotary switch device according to any one of claims 1 to 5, wherein at least some of the fixed contact points are disposed flush with a sliding surface formed on the case half so that the movable contact point slides against the sliding surface, a grease reservoir is formed on a rear part of the sliding surface, and the sliding surface and the grease reservoir are connected to each other via a connecting hole positioned on a locus, accompanying pivoting of the pivoting shaft, of the movable contact point on a sliding contact area of the sliding surface.

9. The rotary switch device according to any one of claims 1 to 5, wherein at least some of the fixed contact points are disposed flush with a sliding surface formed on the case half so that the movable contact point slides against the sliding surface, a grease reservoir is formed in a rear part of the movable contact point, and a connecting hole is provided in an area, in sliding contact with the sliding surface, of the movable contact point having the grease reservoir formed in the rear part, the connecting hole having an inner end communicating with the interior of the grease reservoir and having an open outer end.

10. The rotary switch device according to claim 6, wherein the abutment engagement part is projectingly provided integrally with the contact point plate.

11. The rotary switch device according to claim 6, wherein a cam lobe is provided on the guide part, the cam lobe being formed in a peak shape in which an ascent part and a descent part are connected in sequence along a direction of movement of the rotor in which the movable contact point makes contact with the fixed contact point, the abutment engagement part, which abuts against the cam lobe, is held by the rotor while being spring-biased toward the cam lobe side, and the cam lobe is formed so that the movable contact point starts contacting the fixed contact point during the course of the abutment engagement part ascending the ascent part of the cam lobe, and the movable contact point starts separating from the fixed contact points during the course of the abutment engagement part descending the ascent part.

12. A rotary switch device comprising:

first and second switch mechanisms each formed from a movable contact point that pivots in response to pivoting of a pivoting shaft and a fixed contact point that comes into contact with the movable contact point at a set pivot position of the pivoting shaft, wherein the first switch mechanism is formed from the movable contact point disposed on one face of a single rotor coaxially connected to the pivoting shaft so that the single rotor cannot rotate relative to the pivoting shaft, and the fixed contact point provided on an inner face, corresponding to said one face of the rotor, of one of a pair of case halves joined to each other while sandwiching the rotor from opposite sides so as to form a switch case housing the rotor, wherein the second switch mechanism is formed from the movable contact point disposed on the other face of the rotor, and the fixed contact point provided on an inner face of the other case half facing the other face of the rotor, wherein the fixed contact points are formed on a plurality of conductive metal terminal plates insert-bonded to the two case halves, which are made of a synthetic resin, and parts of at least some of the terminal plates project from the case halves so as to form external connection terminals, and wherein a synthetic resin cover member covering at least part of the switch case, which is mounted on a metal body pivotably supporting the pivoting shaft, is mounted on the body, a first coupler half is formed integrally with the body, the first coupler half having a pair of side wall portions sandwiching a plurality of the external connection terminals therebetween and a connecting wall portion connecting the side wall portions and the first coupler half surrounding the external connection terminals on three sides, and a second coupler half is formed integrally with the cover member so as to be detachably fitted into the side wall portions of the first coupler half, the second coupler half forming in cooperation with the first coupler half a coupler that is a cylinder with a rectangular cross section and surrounds the plurality of external connection terminals.

13. The rotary switch device according to claim 12 wherein, among the fixed contact points of the first and second switch mechanisms, the terminal plates forming the fixed contact points connected to a power source are joined to each other outside the two case halves.

14. The rotary switch device according to claim 12, wherein a pair of mating wall portions are provided on the second coupler half so that an inner face of the mating wall portions abuts against an outer face of a partnering coupler when the partnering coupler is fitted into the coupler, the mating wall portions being capable of being fitted into the pair of side wall portions of the first coupler half, and latches are projectingly provided on outer faces of the mating wall portions, the latches being capable of resiliently engaging with the two side wall portions from the inside.

15. The rotary switch device according to claim 12, wherein at least some of the fixed contact points are disposed flush with a sliding surface formed on the case half so that the movable contact point slides against the sliding surface, a grease reservoir is formed on a rear part of the sliding surface, and the sliding surface and the grease reservoir are connected to each other via a connecting hole positioned on a locus, accompanying pivoting of the pivoting shaft, of the movable contact point on a sliding contact area of the sliding surface.

16. The rotary switch device according to claim 12, wherein at least some of the fixed contact points are disposed flush with a sliding surface formed on the case half so that the movable contact point slides against the sliding surface, a grease reservoir is formed in a rear part of the movable contact point, and a connecting hole is provided in an area, in sliding contact with the sliding surface, of the movable contact point having the grease reservoir formed in the rear part, the connecting hole having an inner end communicating with the interior of the grease reservoir and having an open outer end.

17. The rotary switch device according to claim 12, wherein conductive metal contact point plates having the movable contact points are spring-biased toward a side in which the movable contact points come into contact with the fixed contact points, the conductive metal contact point plates being floatingly supported on the rotor, and a click mechanism imparting a restraining feel to pivoting of the pivoting shaft and the rotor is formed from a guide part and an abutment engagement part, the guide part being formed in at least an arc shape with its center on the axis of the pivoting shaft and having positioning parts provided at a plurality of positions, and the abutment engagement part being provided on the contact point plate so as to abut against the guide part, the abutment engagement part being capable of detachably engaging with the positioning parts.

18. The rotary switch device according to claim 17, wherein the abutment engagement part is a rolling body assembled to the contact point plate as a separate body from the contact point plate.

19. The rotary switch device according to claim 17, wherein the abutment engagement part is projectingly provided integrally with the contact point plate.

20. The rotary switch device according to claim 17, wherein a cam lobe is provided on the guide part, the cam lobe being formed in a peak shape in which an ascent part and a descent part are connected in sequence along a direction of movement of the rotor in which the movable contact point makes contact with the fixed contact point, the abutment engagement part, which abuts against the cam lobe, is held by the rotor while being spring-biased toward the cam lobe side, and the cam lobe is formed so that the movable contact point starts contacting the fixed contact point during the course of the abutment engagement part ascending the ascent part of the cam lobe, and the movable contact point starts separating from the fixed contact points during the course of the abutment engagement part descending the ascent part.

21. A rotary switch device comprising:

first and second switch mechanisms each formed from a movable contact point that pivots in response to pivoting of a pivoting shaft and a fixed contact point that comes into contact with the movable contact point at a set pivot position of the pivoting shaft, wherein the first switch mechanism is formed from the movable contact point disposed on one face of a single rotor coaxially connected to the pivoting shaft so that the single rotor cannot rotate relative to the pivoting shaft, and the fixed contact point provided on an inner face, corresponding to said one face of the rotor, of one of a pair of case halves joined to each other while sandwiching the rotor from opposite sides so as to form a switch case housing the rotor, wherein the second switch mechanism is formed from the movable contact point disposed on the other face of the rotor, and the fixed contact point provided on an inner face of the other case half facing the other face of the rotor, and wherein conductive metal contact point plates having the movable contact points are spring-biased toward a side in which the movable contact points come into contact with the fixed contact points, the conductive metal contact point plates being floatingly supported on the rotor, and a click mechanism imparting a restraining feel to pivoting of the pivoting shaft and the rotor is formed from a guide part and an abutment engagement part, the guide part being formed in at least an arc shape with its center on the axis of the pivoting shaft and having positioning parts provided at a plurality of positions, and the abutment engagement part being provided on the contact point plate so as to abut against the guide part, the abutment engagement part being capable of detachably engaging with the positioning parts.

22. The rotary switch device according to claim 21, wherein the fixed contact points are formed on a plurality of conductive metal terminal plates insert-bonded to the two case halves, which are made of a synthetic resin, and parts of at least some of the terminal plates project from the case halves so as to form external connection terminals.

23. The rotary switch device according to claim 22 wherein, among the fixed contact points of the first and second switch mechanisms, the terminal plates forming the fixed contact points connected to a power source are joined to each other outside the two case halves.

24. The rotary switch device according to claim 22, wherein a synthetic resin cover member covering at least part of the switch case, which is mounted on a mat body pivotably supporting the pivoting shaft, is mounted on the body, a first coupler half is formed integrally with the body, the first coupler half having a pair of side wall portions sandwiching a plurality of the external connection terminals therebetween and a connecting wall portion connecting the side wall portions and the first coupler half surrounding the external connection terminals on three sides, and a second coupler half is formed integrally with the cover member so as to be detachably fitted into the side wall portions of the first coupler half, the second coupler half forming in cooperation with the first coupler half a coupler that is a cylinder with a rectangular cross section and surrounds the plurality of external connection terminals, and wherein a pair of mating wall portions are provided on the second coupler half so that an inner face of the mating wall portions abuts against an outer face of a partnering coupler when the partnering coupler is fitted into the coupler, the mating wall portions being capable of being fitted into the pair of side wall portions of the first coupler half, and latches are projectingly provided on outer faces of the mating wall portions, the latches being capable of resiliently engaging with the two side waLl portions from the Inside.

25. The rotary switch device according to claim 21, wherein at least some of the fixed contact points are disposed flush with a sliding surface formed on the case half so that the movable contact point slides against the sliding surface, a grease reservoir is formed on a rear part of the sliding surface, and the sliding surface and the grease reservoir are connected to each other via a connecting hole positioned on a locus, accompanying pivoting of the pivoting shaft, of the movable contact point on a sliding contact area of the sliding surface.

26. The rotary switch device according to claim 21, wherein at least some of the fixed contact points are disposed flush with a sliding surface formed on the case half so that the movable contact point slides against the sliding surface, a grease reservoir is formed in a rear part of the movable contact point, and a connecting hole is provided in an area, in sliding contact with the sliding surface, of the movable contact point having the grease reservoir formed in the rear part, the connecting hole having an inner end communicating with the interior of the grease reservoir and having an open outer end.

27. The rotary switch device according to claim 21, wherein the abutment engagement part is a rolling body assembled to the contact point plate as a separate body from the contact point plate.

28. The rotary switch device according to claim 21, wherein the abutment engagement part is projectingly provided integrally with the contact point plate.

29. The rotary switch device according to claim 21, wherein a cam lobe is provided on the guide part, the cam lobe being formed in a peak shape in which an ascent part and a descent part are connected in sequence along a direction of movement of the rotor in which the movable contact point makes contact with the fixed contact point, the abutment engagement part, which abuts against the cam lobe, is held by the rotor while being spring-biased toward the cam lobe side, and the cam lobe is formed so that the movable contact point starts contacting the fixed contact point during the course of the abutment engagement part ascending the ascent part of the cam lobe, and the movable contact point starts separating from the fixed contact points during the course of the abutment engagement part descending the ascent part.

* * * * *